US010058468B2

(12) United States Patent
Morin et al.

(10) Patent No.: US 10,058,468 B2
(45) Date of Patent: Aug. 28, 2018

(54) SIDERAIL SYSTEM FOR A BED

(71) Applicant: Umano Medical Inc., L'Islet (CA)

(72) Inventors: Marco Morin, Lévis (CA); Guy Lemire, Beaumont (CA); Gabriel Mercier, Saint-Vallier (CA)

(73) Assignee: UMANO MEDICAL INC., L'Islet (CA)

( * ) Notice: Subject to any disclaimer, the term of this patent is extended or adjusted under 35 U.S.C. 154(b) by 52 days.

(21) Appl. No.: 14/838,079

(22) Filed: Aug. 27, 2015

(65) Prior Publication Data

US 2016/0058640 A1 Mar. 3, 2016

Related U.S. Application Data

(60) Provisional application No. 62/043,010, filed on Aug. 28, 2014.

(51) Int. Cl.

| | |
|---|---|
| ***A47C 21/08*** | (2006.01) |
| ***A61G 7/05*** | (2006.01) |
| ***A47D 7/00*** | (2006.01) |
| ***A61G 7/015*** | (2006.01) |

(52) U.S. Cl.

CPC ..... *A61G 7/0507* (2013.01); *A47C 21/08* (2013.01); *A61G 7/0509* (2016.11); *A61G 7/0514* (2016.11)

(58) Field of Classification Search

CPC .. A61G 7/0507; A61G 7/0508; A61G 7/0509; A61G 7/0514; A61G 7/0516; A61G 7/052; A61G 7/051; A61G 7/0524

See application file for complete search history.

(56) References Cited

U.S. PATENT DOCUMENTS

| | | | | |
|---|---|---|---|---|
| 5,187,824 | A | 2/1993 | Stryker | |
| 6,253,397 | B1 | 7/2001 | Bartow et al. | |
| 6,360,385 | B1 | 3/2002 | Lewandowski | |
| 6,640,360 | B2 | 11/2003 | Hornbach et al. | |
| 6,779,209 | B2 | 8/2004 | Ganance | |
| 6,938,289 | B2 * | 9/2005 | Morin | A61G 5/10 5/425 |
| 7,028,352 | B2 * | 4/2006 | Kramer | A61G 7/05 428/430 |
| 7,073,220 | B2 * | 7/2006 | Simmonds | A47C 19/045 292/36 |
| 7,076,818 | B2 | 7/2006 | Kummer et al. | |

(Continued)

*Primary Examiner* — Robert G Santos
*Assistant Examiner* — Rahib T Zaman
(74) *Attorney, Agent, or Firm* — Steptoe & Johnson LLP

(57) ABSTRACT

A siderail assembly for a bed, the bed having a patient support assembly, the siderail assembly comprising: a siderail disposed in a siderail plane; a mounting member for mounting to the patient support assembly; at least two parallel connecting arms, each connecting arm having a first end pivotably connected to the mounting member and a second end pivotably connected to the siderail, each connecting arm being adapted to pivot relative to the siderail about a first pivot axis and to pivot relative to the mounting member about a second pivot axis to allow the siderail to pivot along an arcuate path relative to the mounting member, the first and second pivot axes being parallel to each other and angled relative to the siderail plane to allow the siderail to move in a direction perpendicular to the siderail plane when pivoting.

8 Claims, 37 Drawing Sheets

(56) References Cited

U.S. PATENT DOCUMENTS

| | | | | |
|---|---|---|---|---|
| 7,107,637 | B2 * | 9/2006 | Kuek | A61G 7/0509 5/428 |
| 7,472,439 | B2 * | 1/2009 | Lemire | A61G 7/005 177/144 |
| 7,712,167 | B2 * | 5/2010 | Guguin | A61G 7/0507 5/429 |
| 7,784,125 | B2 | 8/2010 | Morin et al. | |
| 8,104,118 | B2 * | 1/2012 | Derenne | A61G 7/0507 5/425 |
| 8,387,179 | B2 * | 3/2013 | Metz | A61G 7/0507 5/425 |
| 2004/0237195 | A1 | 12/2004 | Ganance | |
| 2005/0166320 | A1 * | 8/2005 | Lemire | A61G 7/0509 5/425 |
| 2006/0090259 | A1 * | 5/2006 | Castonguay | A61G 7/0509 5/430 |
| 2007/0174965 | A1 * | 8/2007 | Lemire | A61G 7/005 5/600 |
| 2009/0139028 | A1 * | 6/2009 | Morin | A61G 7/0507 5/430 |
| 2011/0037597 | A1 * | 2/2011 | Dixon | A61G 7/0528 340/573.4 |
| 2012/0005832 | A1 | 1/2012 | Turner et al. | |

* cited by examiner

SIDERAIL SYSTEM FOR A BED

TECHNICAL FIELD

The present invention relates to patient support apparatuses such as hospital beds. In particular, the invention relates to patient support apparatuses with movable siderails.

BACKGROUND OF THE ART

Hospital beds are beds which are usually provided with specialized features to assist medical personnel in providing care for patients. A hospital bed typically comprises a patient support surface on which a patient can lie down and a plurality of barriers or siderails disposed around the patient support surface. Usually, the siderails can be lowered to allow the patient to be easily placed on the patient support surface, and then raised to prevent the patient from falling from the patient support surface or from getting out of the bed.

Unfortunately, the width of the bed is often increased when the siderails are lowered in existing beds. This may cause difficulties when displacing the bed through a room door frame or when entering/exiting an elevator with the bed.

Furthermore, the siderails, when lowered, may also create obstacles around the bed, making it harder for medical personnel to adequately interact with the patient lying on the bed or to perform maintenance of the bed. This may further make it harder for patients to enter and exit the bed.

Most siderails also include unreliable locking system for siderails and typically do not provide any indication that they are properly locked in place when raised. Siderails could therefore be inadvertently left unsecured and fall unexpectedly, which may possibly lead to injuries and/or damage to the bed or cause loud noises which is indesirable in hospitals and most care facilities.

Existing siderails displacement systems may also include grooves and crevices which may make it difficult to properly clean and disinfect the bed.

Example prior art hospital beds are described in U.S. Patent Application Publication Nos. 20120005832, 20040237195, and in U.S. Pat. Nos. 5,187,824, 6,253,397, 6,360,385, 7,073,220, 7,076,818, 7,107,637, 7,028,352, 7,784,125, 6,779,209, 8,104,118, 6,938,289, 8,387,179, 7,712,167, 6,640,360, 7,472,439.

SUMMARY

According to one aspect, there is provided a siderail assembly for a bed, the bed having a patient support assembly, the siderail assembly comprising: a siderail disposed in a siderail plane; a mounting member for mounting to the patient support assembly; at least two parallel connecting arms, each connecting arm having a first end pivotably connected to the mounting member and a second end pivotably connected to the siderail, each connecting arm being adapted to pivot relative to the siderail about a first pivot axis and to pivot relative to the mounting member about a second pivot axis to allow the siderail to pivot along an arcuate path relative to the mounting member, the first and second pivot axes being parallel to each other and angled relative to the siderail plane to allow the siderail to move in a direction perpendicular to the siderail plane when pivoting.

In one embodiment, the first and second pivot axes are angled downwardly relative to a horizontal plane to allow the siderail to pivot between a raised position in which the siderail is in a first siderail plane and a lowered position in which the siderail is in a second siderail plane parallel to the first siderail plane and spaced therefrom.

In one embodiment, each connecting arm is disposed in an arm plane, the arm plane being angled relative to the siderail plane.

In one embodiment, the siderail plane is vertical.

In one embodiment, the siderail motion assembly includes a damper connecting the mounting member to at least one of the at least two connecting arms for damping the pivoting of the siderail.

In one embodiment, the siderail assembly further comprises a locking assembly movable between a locked position preventing the pivoting of the siderail and an unlocked position allowing the pivoting of the siderail.

In one embodiment, the siderail assembly further comprises an indicator for providing an indication of whether the locking assembly is in the locked position or the unlocked position.

In one embodiment, the siderail assembly further comprises a nudging assembly for preventing the siderail from remaining at an intermediate position in which a centerline of the connecting arms is at an angle of 90 degrees relative to the horizontal

BRIEF DESCRIPTION OF THE DRAWINGS

Having thus generally described the nature of the invention, reference will now be made to the accompanying drawings, showing by way of illustration example embodiments thereof and in which.

DETAILED DESCRIPTION

Figure 1:
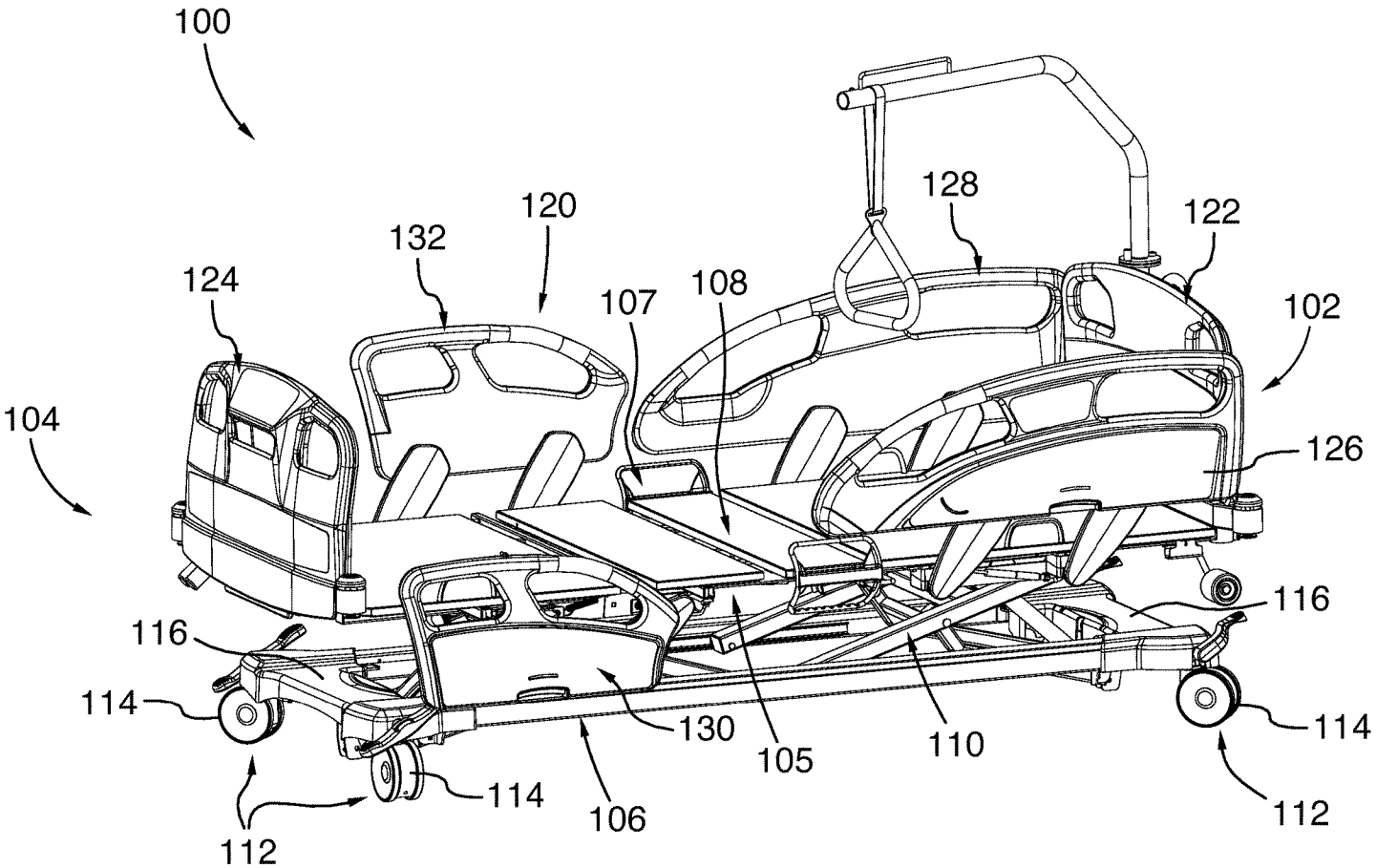
FIG. 1 is a top perspective view of a hospital bed, in accordance with one embodiment, showing the siderail of the right foot siderail assembly in a lowered position.
Figure 2:
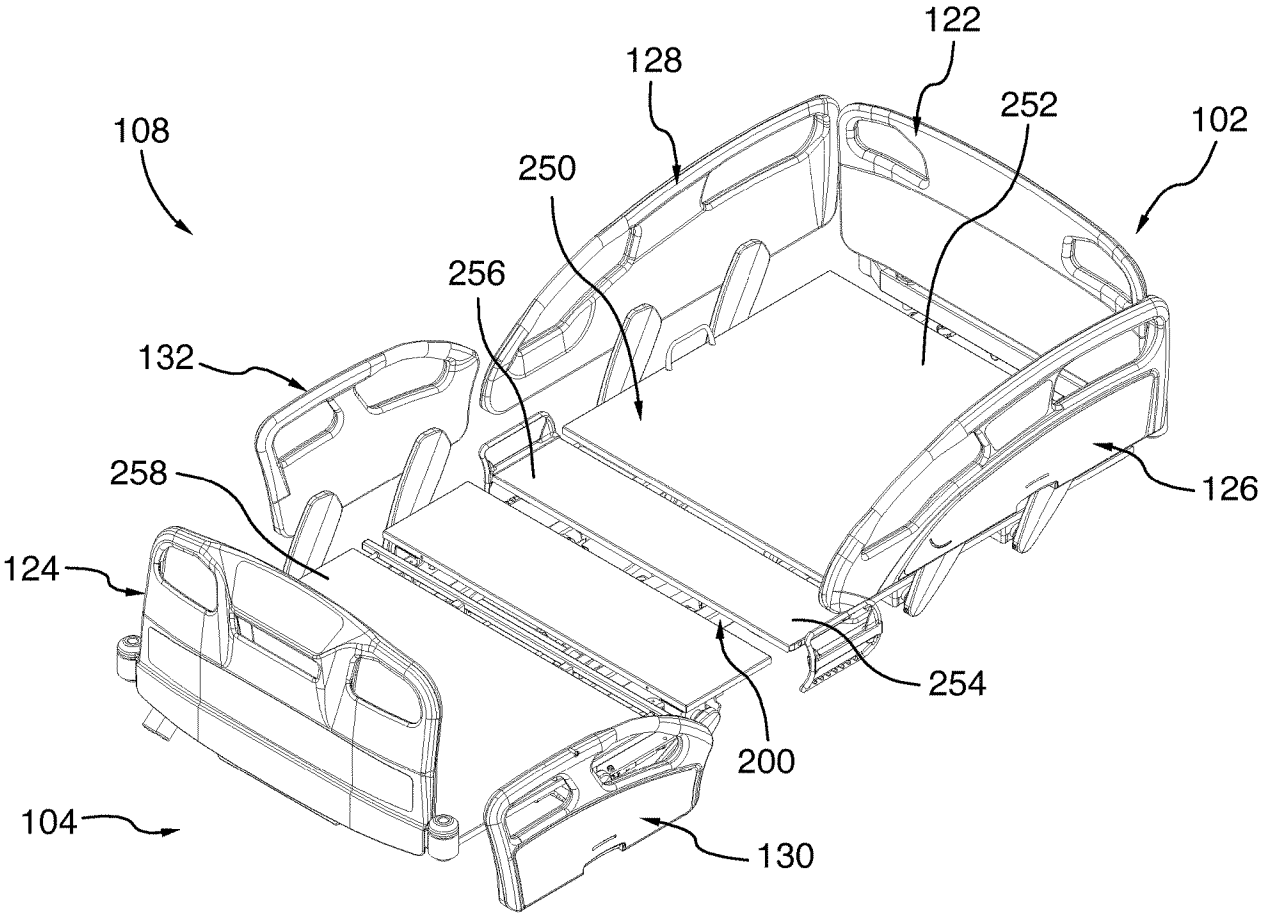
FIG. 2 is an isolated, top perspective view of a patient support assembly for the hospital bed illustrated in FIG. 1.
Figure 3:
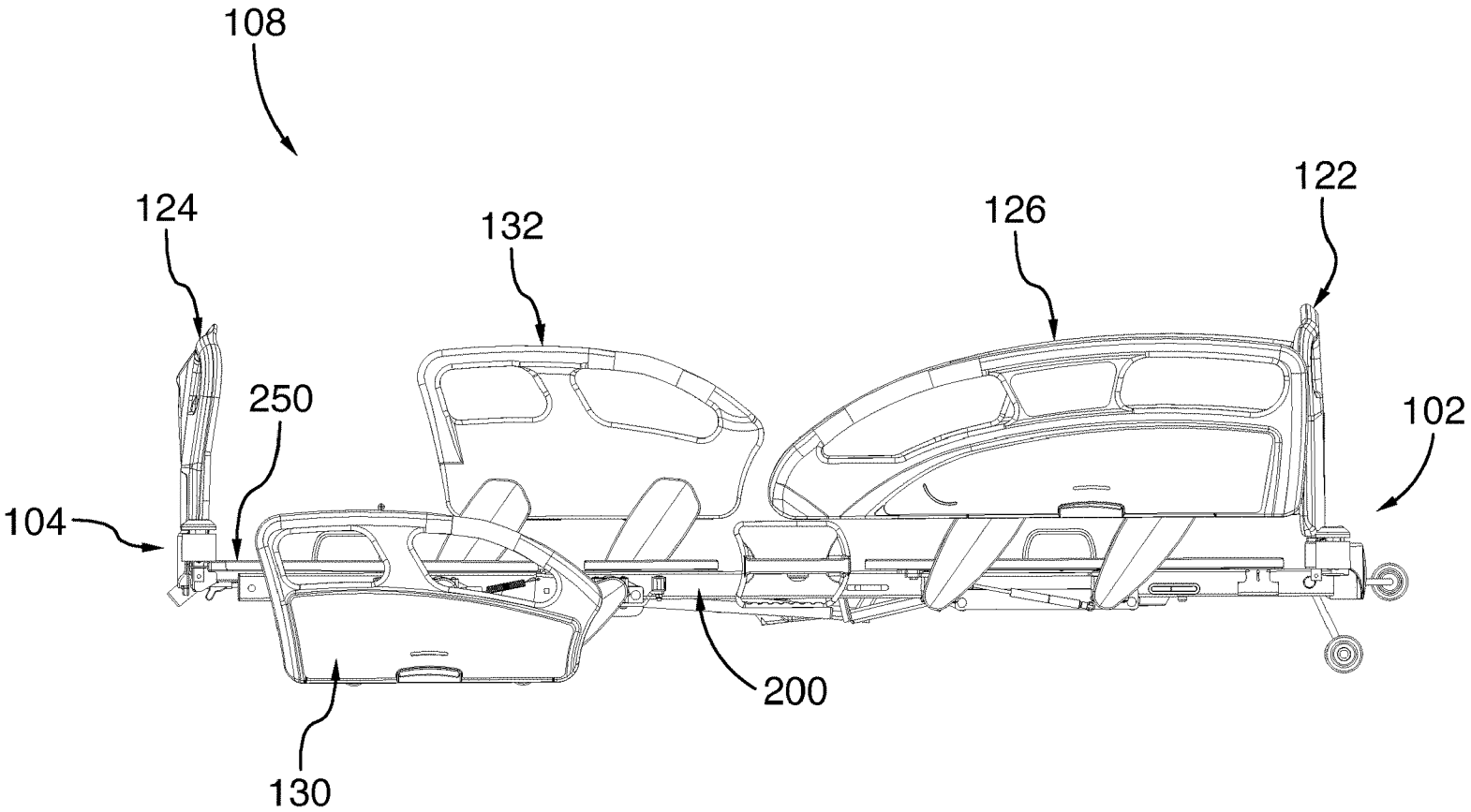
FIG. 3 a left side elevation view of the patient support assembly illustrated in FIG. 2.
Figure 4:
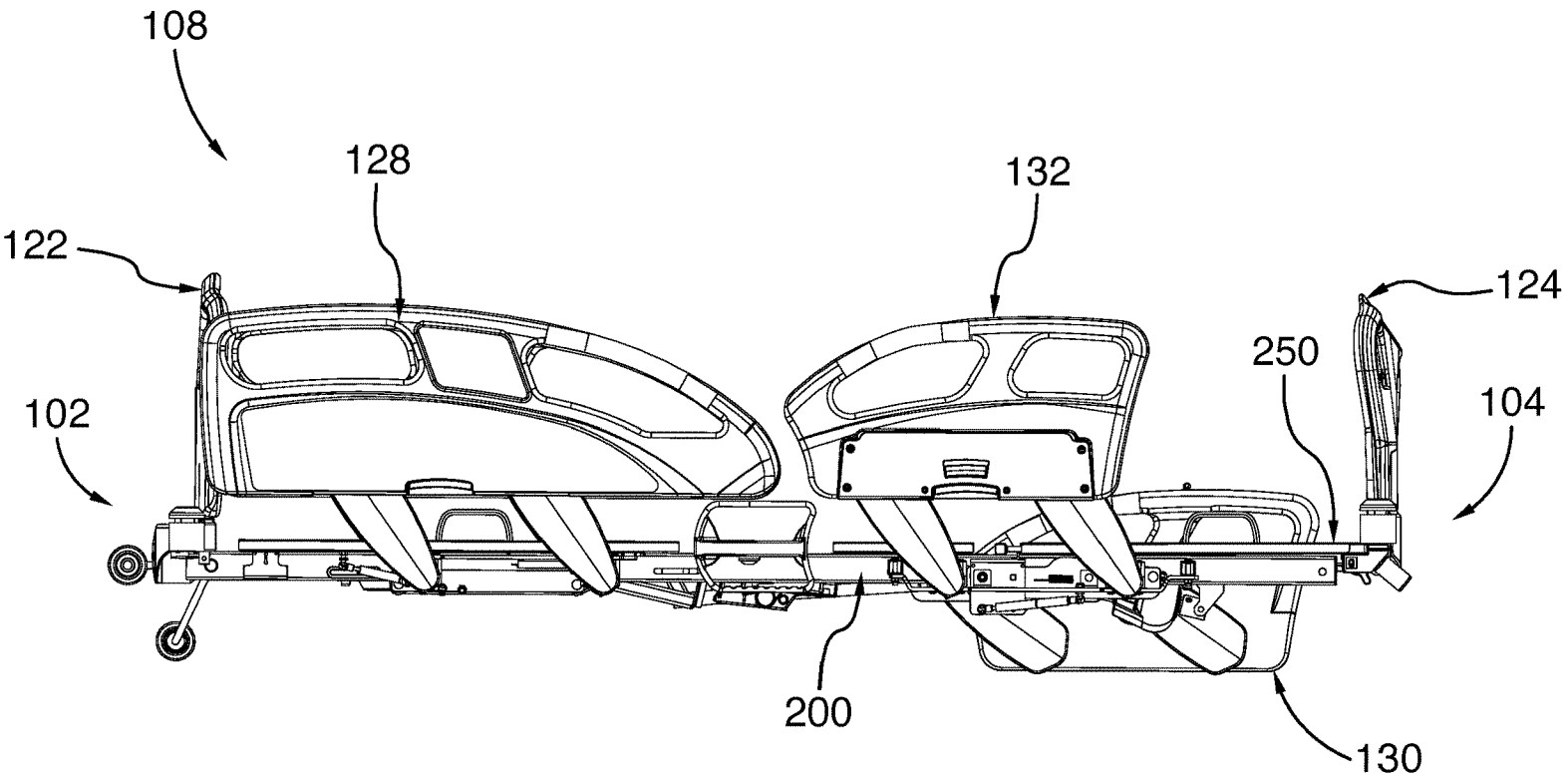
FIG. 4 a right side elevation view of the patient support assembly illustrated in FIG. 2.

Referring first to FIG. 1, there is shown a hospital bed 100, in accordance with one embodiment. The bed 100 comprises a head end 102, an opposite foot end 104 and spaced-apart left and right sides 105, 107 extending between the head end 102 and the foot end 104.

Some of the structural components of the bed 100 will be designated hereinafter as "right", "left", "head" and "foot" from the reference point of an individual lying on the individual's back on the support surface of the mattress provided on the bed 100 with the individual's head oriented toward the head end 102 of the bed 100 and the individual's feet oriented toward the opposing foot end 104 of the bed 100. Similarly, the term "headward" refers to an element located towards the head end 102 of the bed 100 and the term "footward" refers to an element located towards the foot end 104 of the bed 100. Furthermore "interior" and "exterior" views are also designated from the reference point of the individual lying in the bed. Therefore, an interior view shows an element as seen by the patient looking toward the environment outside of the bed and an exterior view shows an element as seen by medical staff outside of the bed. Generally, an exterior view shows the exterior surfaces of the bed and the interior view shows the interior surfaces of the bed. The terms "inner" and "outer" will similarly be used to describe the position of elements relative to the bed.

The bed 100 includes a base 106, a patient support assembly 108 and an elevation system 110 operatively coupling the patient support assembly 108 to the base 106. In the illustrated embodiment, the base 106 is provided with a displacement assembly 112 which includes casters 114 connected to the base 106 by pivots (not shown) hidden from view by covers 116. This displacement assembly 112 allows the bed 100 to be moved and maneuvered along a floor.

The elevation system 110 is configured to raise and lower the patient support assembly 108 relative to the base 106 between a minimum or fully lowered position and a maximum or fully raised position. In one embodiment, the elevation system 110 is further configured to allow the patient support assembly 108 to be set at any intermediate position between the fully lowered and fully raised positions. The elevation system 110 may further be configured to tilt the patient support assembly 108 in various orientations, as will be further explained below.

Still referring to FIG. 1, the bed 100 further includes a patient support barrier system 120 generally disposed around the patient support assembly 108. The barrier system 120 includes a plurality of barriers which extend generally vertically around the patient support assembly 108. In the illustrated embodiment, the plurality of barriers includes a headboard 122 located at the head end 102 and a footboard 124 disposed generally parallel to the headboard 122 and located at the foot end 104 of the bed 100. The plurality of barriers further include spaced-apart left and right head siderail assemblies 126, 128 which are located adjacent the headboard 122 and spaced-apart left and right foot siderail assemblies 130, 132 which are respectively located between the left and right head siderail assemblies 126, 128 and the foot end 104 of the bed 100. Each one of the plurality of barriers is moveable between an extended or raised position for preventing the patient lying on the bed 100 from moving laterally out of the bed 100, and a retracted or lowered position for allowing the patient to move or be moved laterally out of the bed 100, as will be further explained below.

Now referring to FIGS. 2 to 5, the patient support assembly 108 includes a frame 200 (best shown in FIG. 5) and a patient support surface 250 supported by the frame 200. A lying surface such as a mattress or the like, not shown, is typically provided on the patient support surface 250 for receiving the patient thereon. In the illustrated embodiment, the patient support surface 250 includes a plurality of adjacent body support panels which could be angled relative to each other to place the bed 100 in different configurations. Alternatively, the patient support surface 250 could include a single body support panel.

Figure 5:
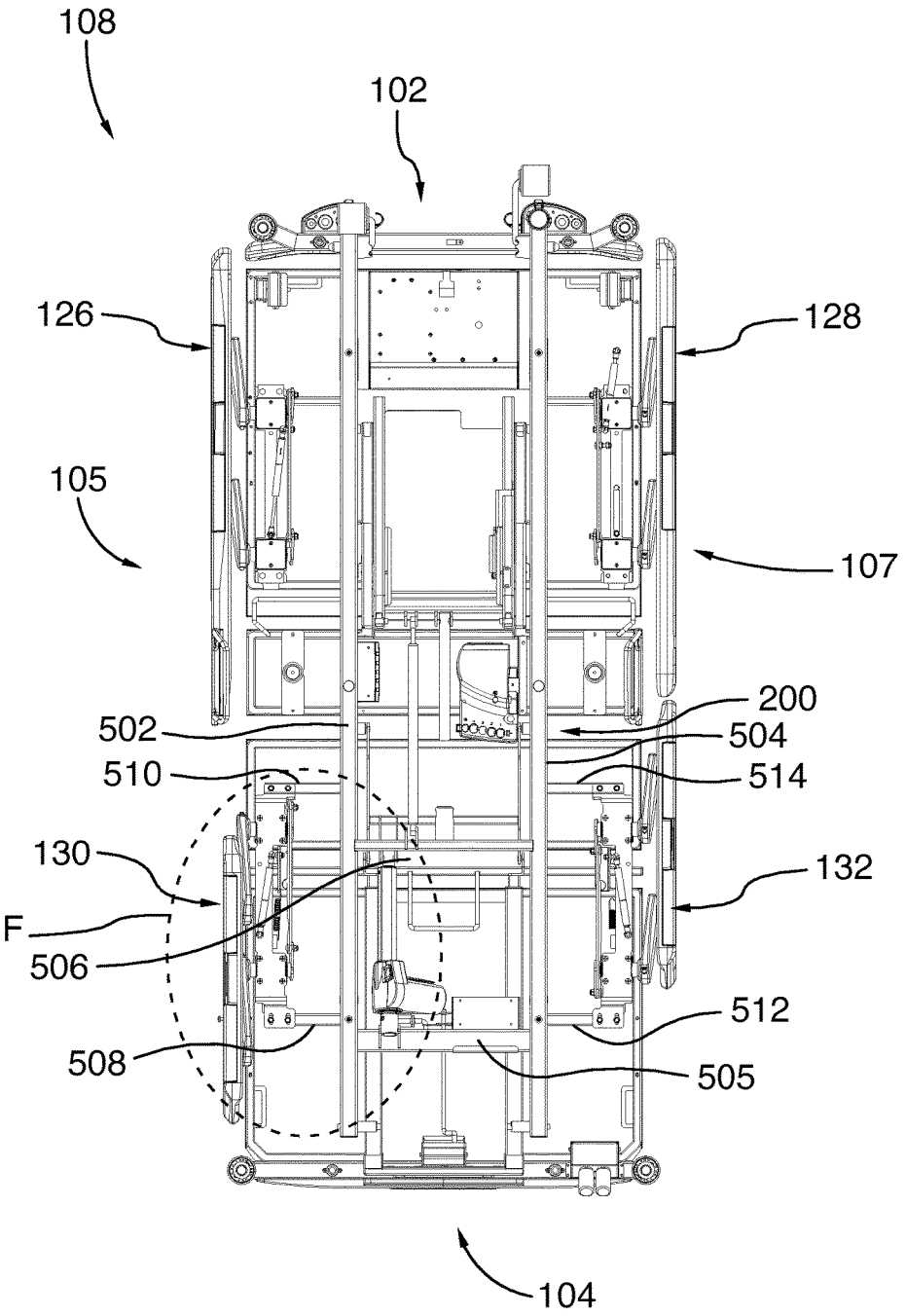
FIG. 5 is a bottom plan view of the patient support assembly illustrated in FIG. 2.
Figure 5A:
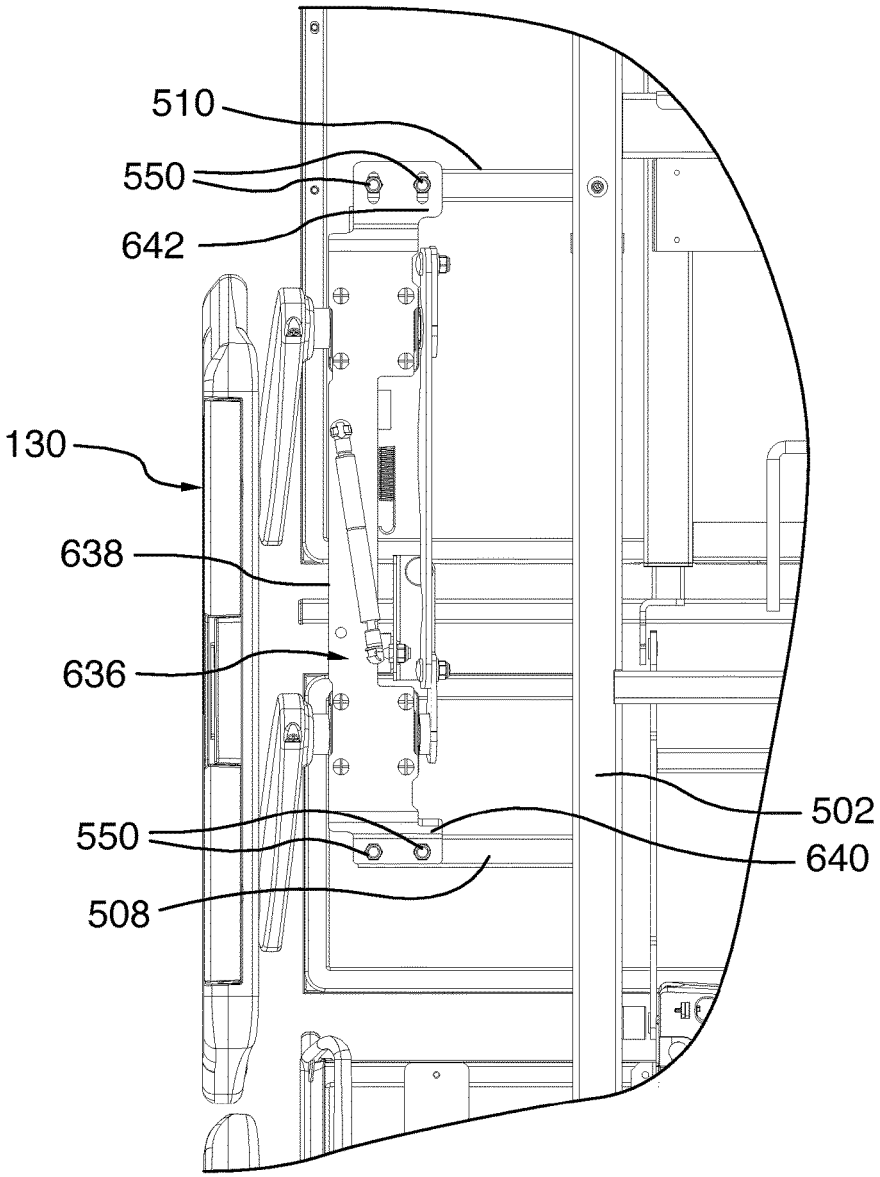
FIG. 5A is a partial bottom plan view of the patient support assembly illustrated in FIG. 2, taken from area F of FIG. 5, enlarged to show details of the mounting of the right head siderail assembly on the frame.

Referring specifically to FIG. 5, the frame 200 includes a pair of longitudinal frame members 502, 504 and a plurality of transversal frame members extending between the longitudinal frame members 502, 504. In the illustrated embodiment, the plurality of transversal members include a foot transversal member 505 located near the foot end 104 of the bed 100 and an intermediate transversal member 506 which is disposed between the foot transversal member 505 and the head end 102 of the bed 100. Alternatively, the frame 200 could include additional transversal members, or a single transversal frame member instead of a plurality of transversal members.

In the illustrated embodiment, the frame 200 further comprises a plurality of siderail mounting members for mounting the siderail assemblies to the bed 100. Specifically, the frame 200 comprises footward and headward left foot siderail mounting members 508, 510 which extend outwardly from the left longitudinal frame member 502 near the foot end 104 of the bed 100. The left foot siderail mounting members 508, 510 are adapted for receiving the left foot siderail assembly 130, as will become apparent below. More specifically, the left foot siderail mounting members 508, 510 are disposed perpendicular to the left longitudinal frame members 402 and parallel to each other. Similarly, the frame 200 also comprises front and rear right foot siderail mounting members 512, 514 which extend outwardly from the right longitudinal frame member 504 near the foot end 104 of the bed 100 for receiving the right foot siderail assembly 132, as will also become apparent below.

Alternatively, the foot siderail assemblies 130, 132 could instead be mounted directly to the longitudinal frame members 502, 504, to the underside of the patient support surface 250 or to any other mounting structure provided on the bed 100.

In the illustrated embodiment, the head siderail assemblies 126, 128 are directly mounted to the patient support surface 250. More specifically, the patient support surface 250 comprises a backrest 252, two core support panels 254, 256 and a lower body support panel 258, and the head siderail assemblies 126, 128 are mounted to the underside of the backrest 252. In the illustrated embodiment, the backrest 252 is adapted to be pivoted relative to the core support panels 254, 256 and the lower body support panel 258. The head siderail assemblies 126, 128 will therefore move along with the backrest 252 when the backrest 252 is pivoted.

Now turning to FIGS. 6 to 11, the right foot siderail assembly 132 will now be described. The same description also applies to the left foot siderail assembly 130, which is a mirror image of the right foot siderail assembly 132.

The right foot siderail assembly 132 comprises a siderail 600, a motion control assembly 602 secured to the patient support assembly 108 and footward and headward parallel connecting arms 604, 606 pivotably connecting the siderail 600 to the motion control assembly 602 to allow the siderail 600 to be rotated relative to the patient support assembly 106 between a lowered position and a raised position.

Figure 7:
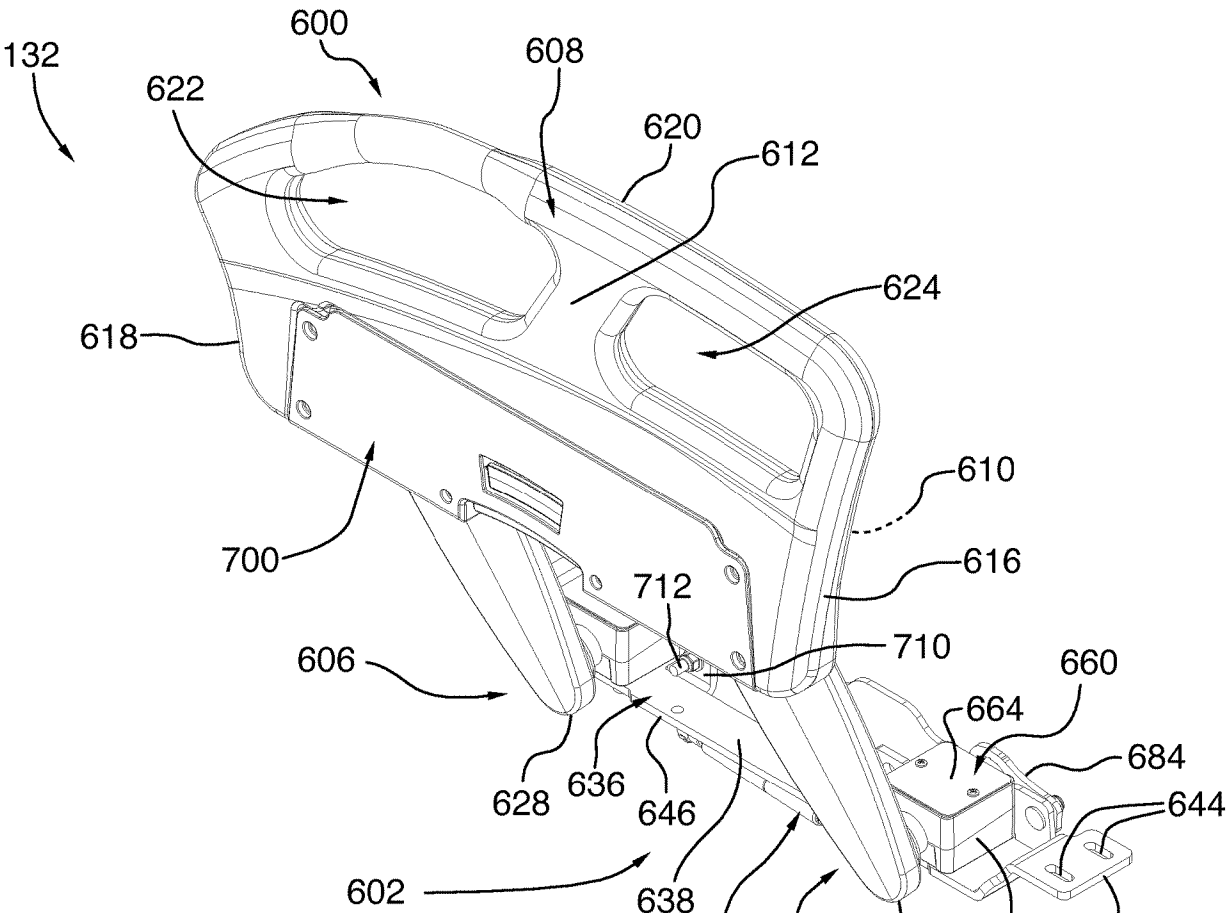
FIG. 7 is a top outer perspective view of the right foot siderail assembly of the hospital bed illustrated in FIG. 1.
Figure 7A:
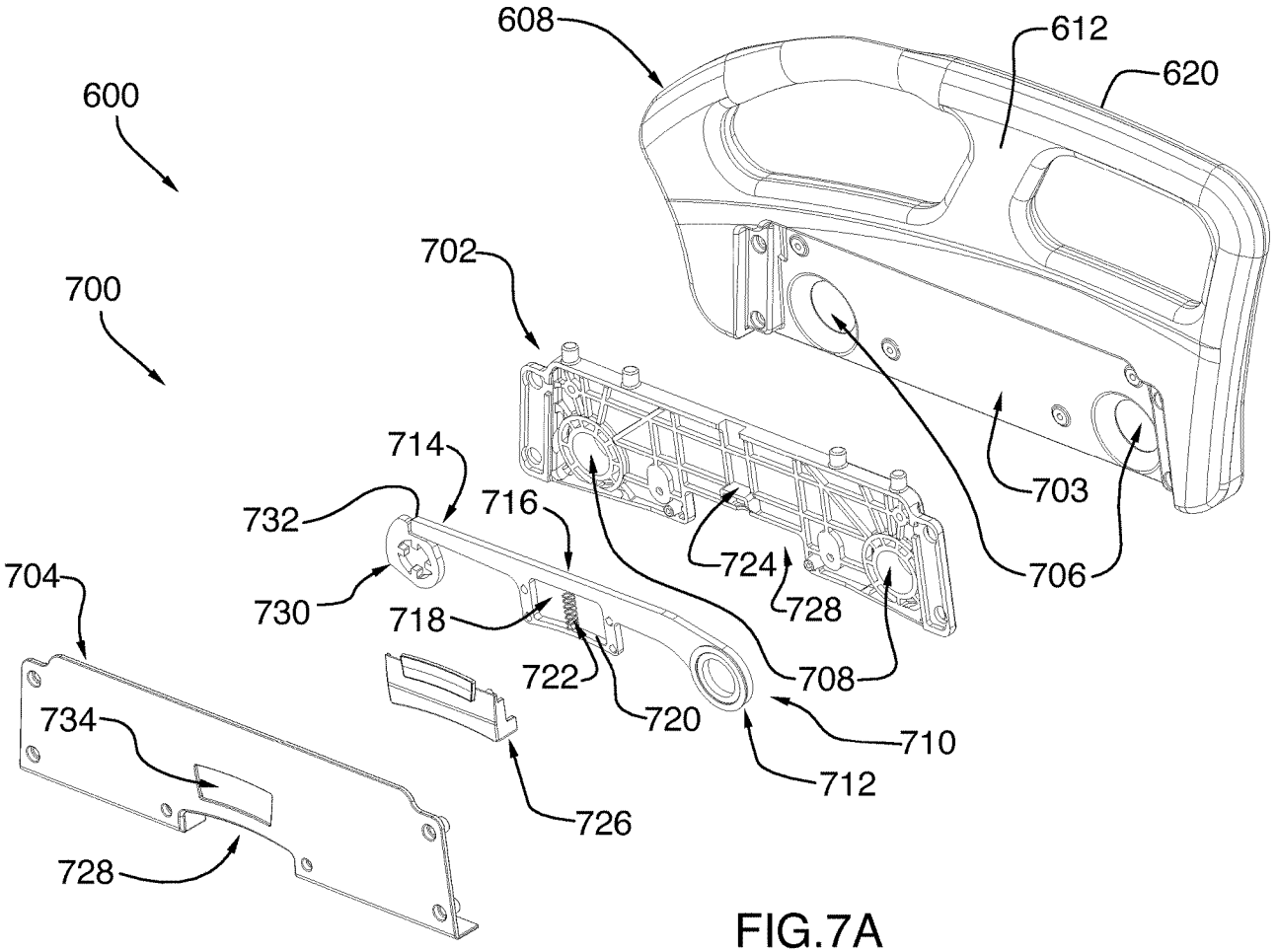
FIG. 7A is a top outer perspective view of the siderail of the right foot siderail assembly illustrated in FIG. 7, showing the locking assembly exploded from the siderail panel.

As best shown in FIG. 7A, the siderail 600 comprises a siderail body or panel 608 and a locking assembly 700 secured to the siderail panel 700. The locking assembly 702 is used to selectively place the right foot siderail assembly 132 in a locked position in which movement of the siderail 600 is prevented and an unlocked position in which movement of the siderail 600 is allowed, as will be further explained below.

Figure 10:
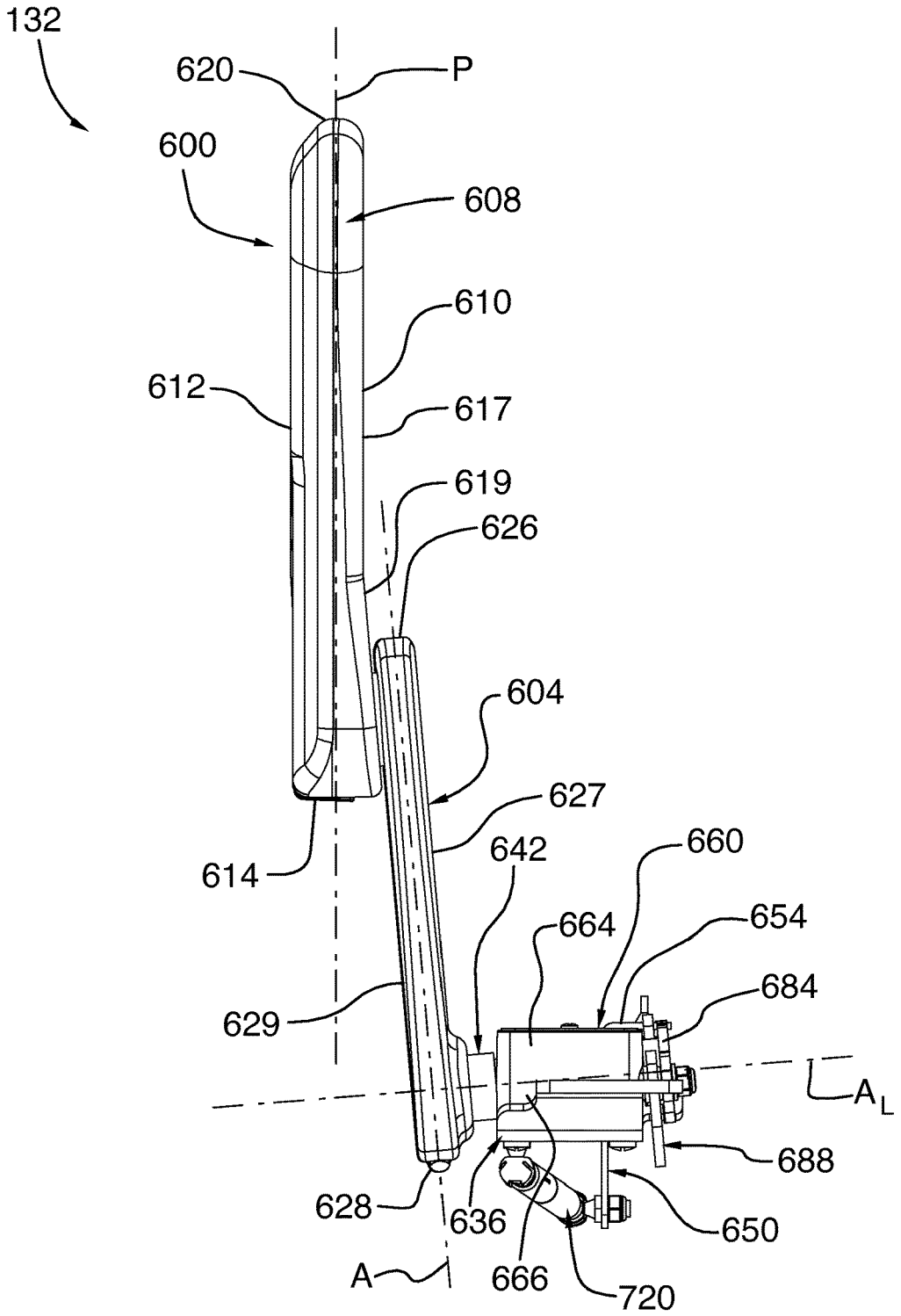
FIG. 10 is a rear end elevation view of the right foot siderail assembly illustrated in FIG. 8.
Figure 10A:
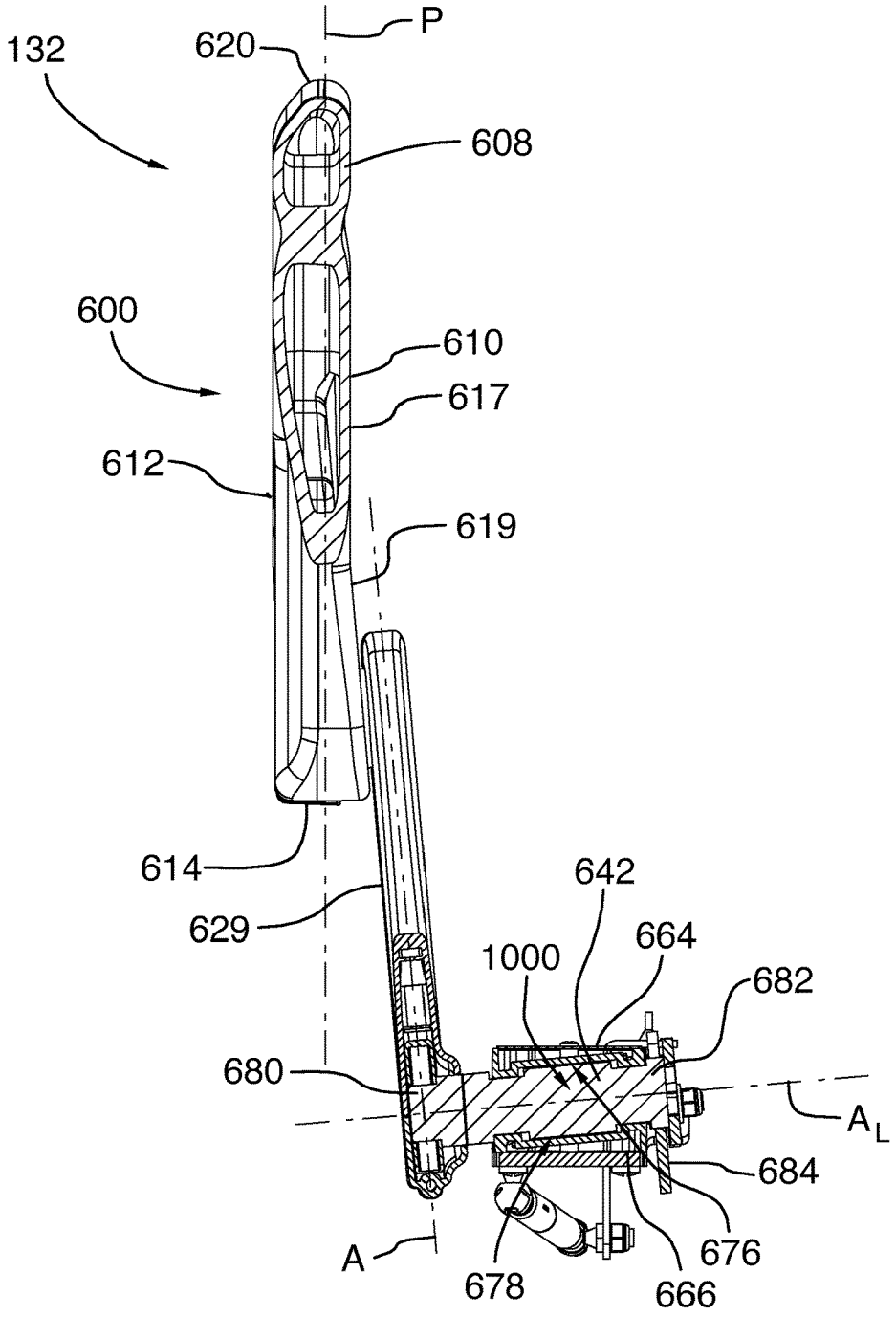
FIG. 10A is a cross-sectional view of the right foot siderail assembly taken along cross-section line X-X of FIG. 8.
Figure 10B:
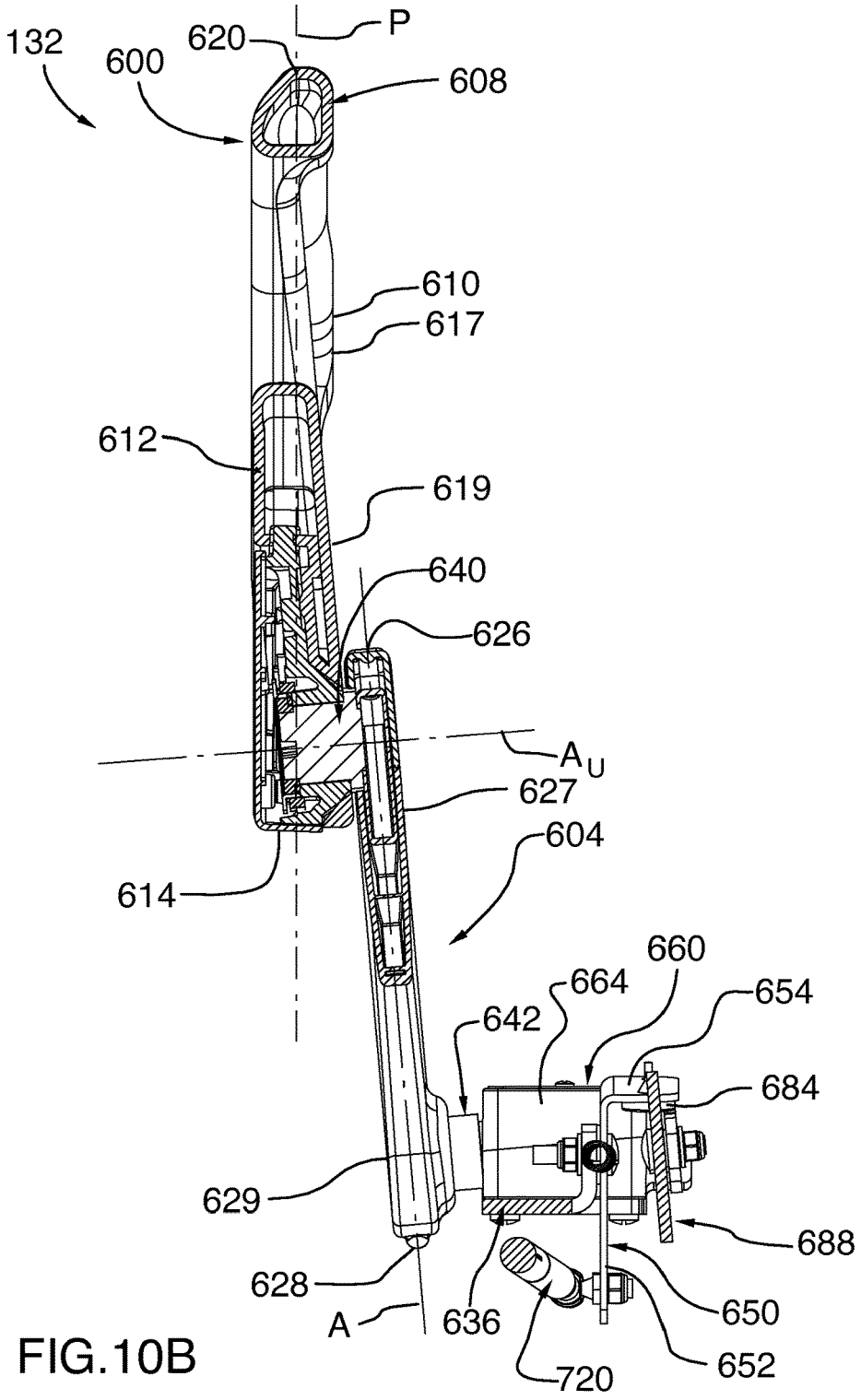
FIG. 10B is another cross-sectional view of the right foot siderail assembly taken along cross-section line B-B of FIG. 8.

The siderail panel 608 is generally planar and extends along a siderail plane P (best shown in FIGS. 10 to 10B). The siderail panel 608 has an inner face 610 located towards the bed 100 and an outer face 612 located opposite the inner face 610. The siderail panel 608 further has a generally straight bottom edge 614, generally concave footward and headward edges 616, 618 extending upwardly from the bottom edge 614 and a curved top edge 620 which curves down at the rear to meet the headward edge 618. Still as best shown in FIGS. 10 to 10A, the outer face 612 is also generally planar and is generally parallel to the siderail plane P. The inner face 610 includes a top portion 617 which is generally planar and generally parallel to the siderail plane P, and a bottom portion 619 which is angled towards the motion control assembly 602 such that the siderail panel 608 flares up towards the bottom edge 614.

In the illustrated embodiment, the siderail panel 608 further includes a first opening 622 located adjacent the top edge 620, near the headward end 618, and a second opening 624 also located adjacent the top edge 620, near the footward edge 616. Both the first and second openings 622, 624 extend all the way through the siderail panel 608 between the inner face 610 and the outer face 612. It will be appreciated that these openings 622, 624 allow the top edge to be easily grabbed for displacing the bed 100 on the floor. The openings 322, 324 can also facilitate the manipulation of the siderail 600 when the siderail 600 is pivoted, as will become apparent below.

Still in the illustrated embodiment, each connecting arm 604, 606 comprises an upper end 626 pivotably connected to the siderail 600 and a lower end 628 pivotably connected to the motion control assembly 602. Each connecting arm 604, 606 is generally elongated and is symmetrical about a longitudinal centerline $A_{CL}$. Each connecting arm 604, 606 is also generally flat and extends generally in an arm plane A (best shown in FIG. 10A). As shown in FIGS. 10 to 10B, the arm plane A is angled relative to the siderail plane P. In one embodiment, the arm plane A is angled relative to the siderail plane P by an angle of 5 degrees. Alternatively, the arm plane A could be angled relative to the siderail plane P by another angle. This configuration allows the siderail 600 to be moved inwardly towards the patient support assembly 108 as the siderail 600 is pivoted from the raised position towards the lowered position, and to be moved outwardly from away from the patient support assembly 108 as the siderail 600 is pivoted from the lowered position towards the raised position, as will be explained below.

Furthermore, each connecting arm 604, 606 includes a generally planar inner face 627 and a generally outer face 629 which are both parallel to the arm plane A. The inner face 627 abuts and extends parallel to the bottom portion 619 of the inner face 610 of the siderail panel 608. This configuration allows the connecting arm 604, 606 to be guided along the bottom portion 619 of the inner face 610 of the siderail panel 608 as the siderail 600 is pivoted, and also allows the angle between the arm plane A and the siderail plane P as the siderail 600 is pivoted.

Figure 6:
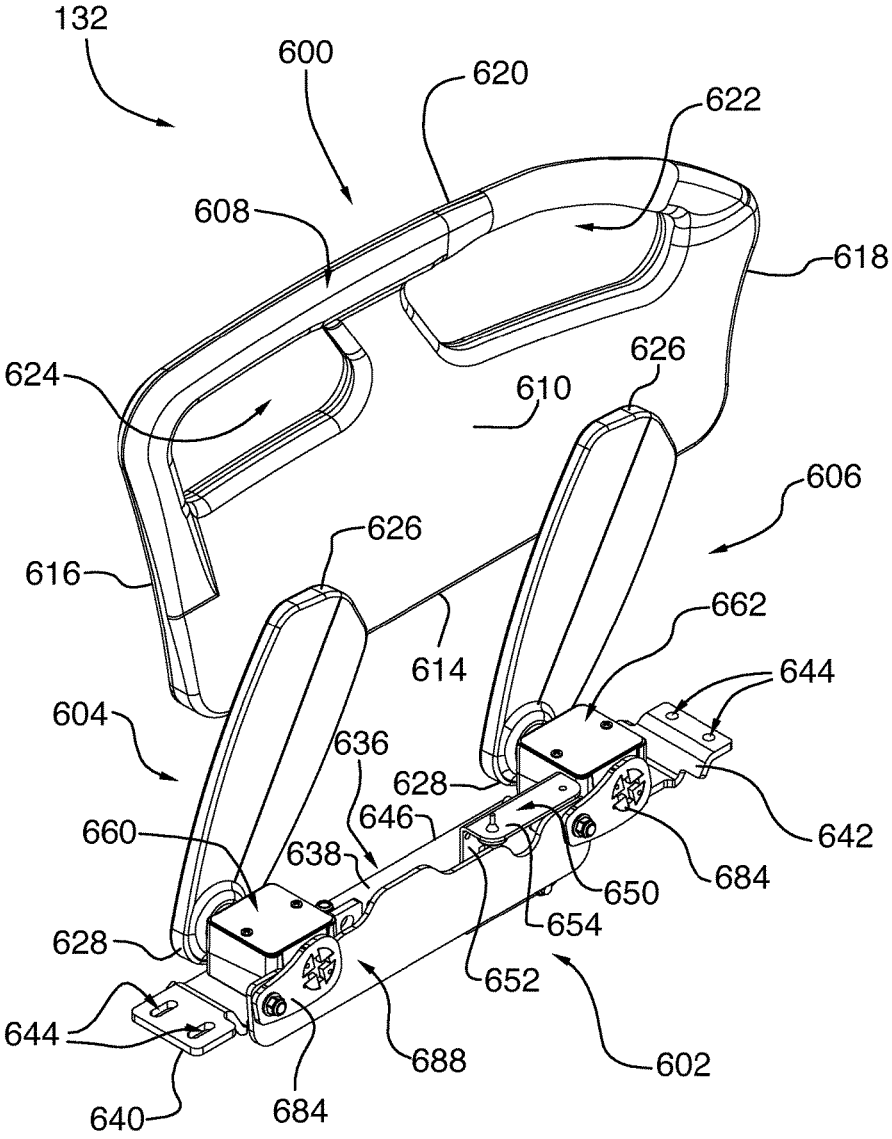
FIG. 6 is a top inner perspective view of the right foot siderail assembly of the hospital bed illustrated in FIG. 1, with the siderail shown in the raised position.
Figure 6A:
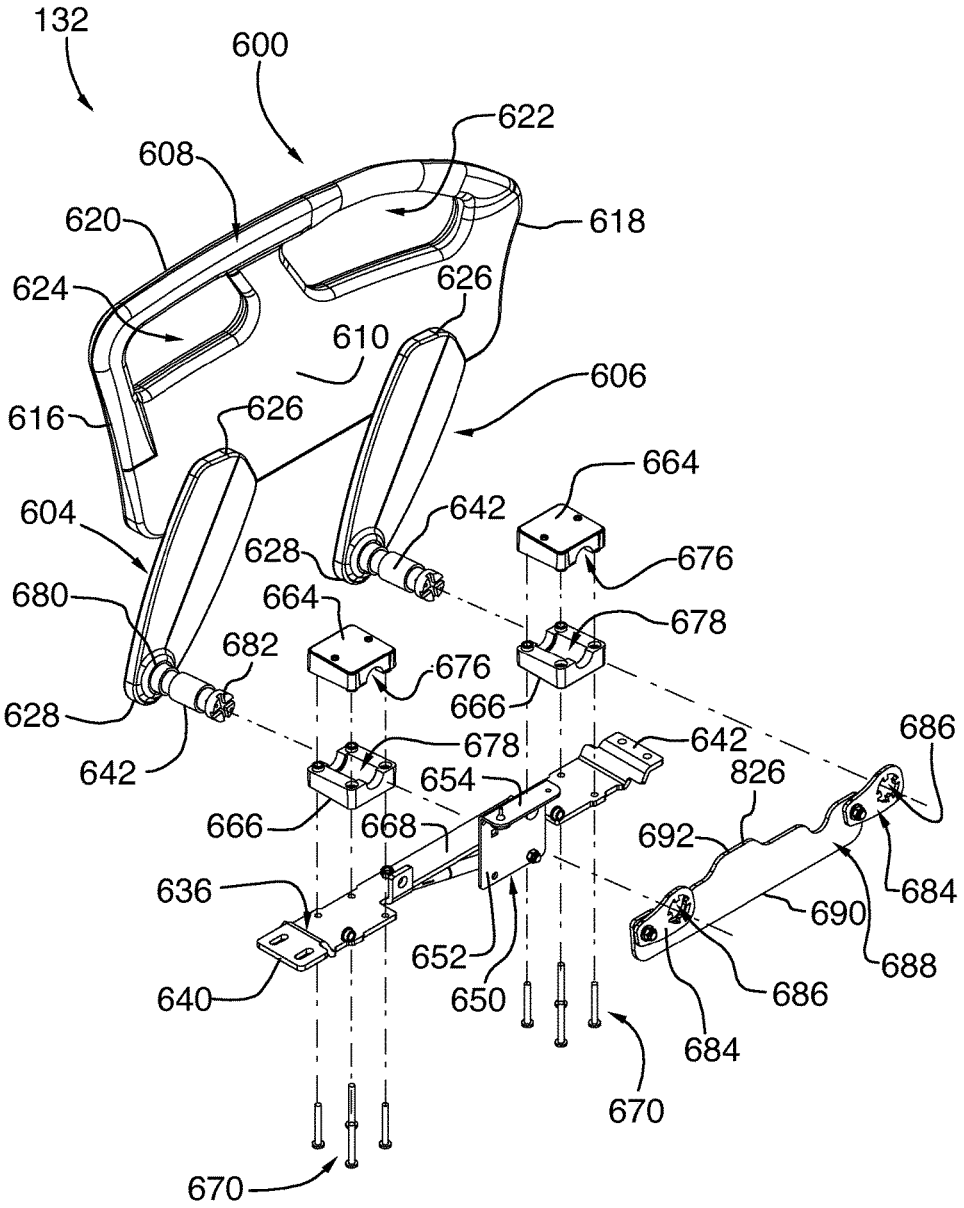
FIG. 6A is a top inner perspective view of the right foot siderail assembly illustrated in FIG. 6, showing the motion control assembly exploded from the siderail and the connecting arms.
Figure 6B:
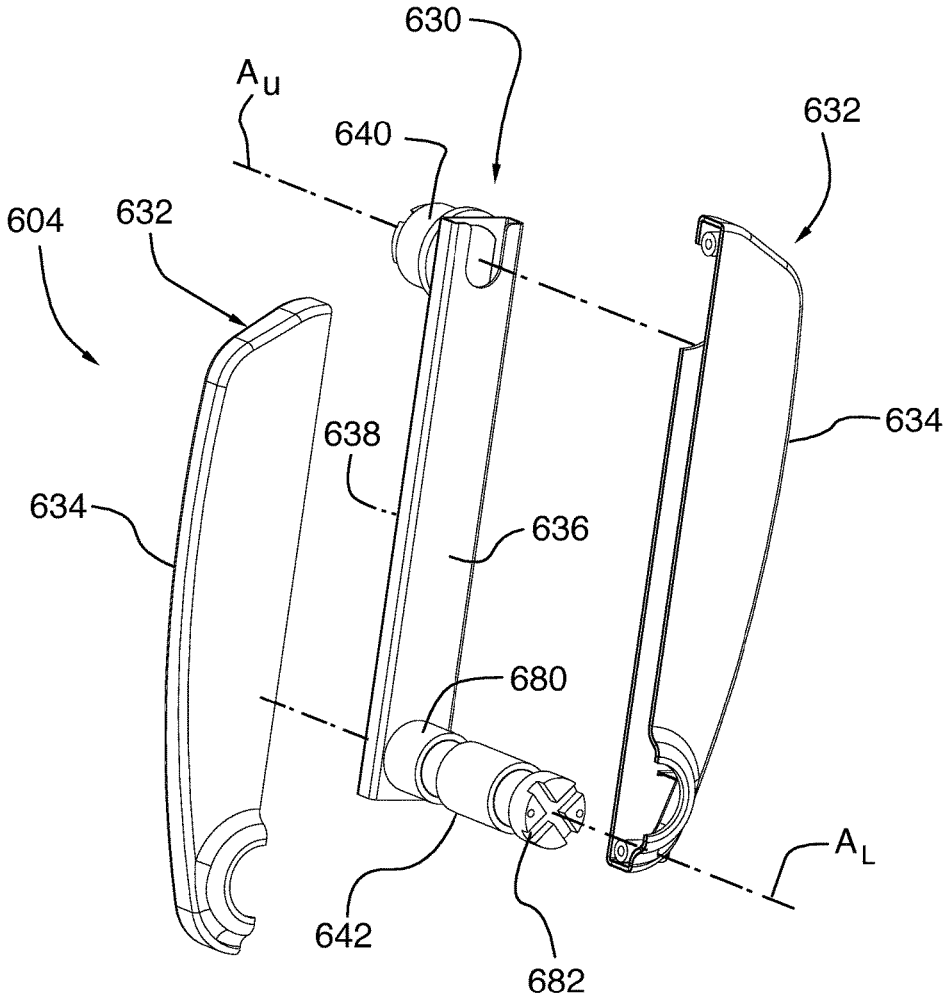
FIG. 6B is an exploded, top perspective view of one of the connecting arms of the right foot siderail assembly illustrated in FIG. 6A.

Referring specifically to FIG. 6B, each connecting arm 604, 606 comprises a central arm member 630 and an outer shell 632 disposed over the central arm member 630. In the illustrated embodiment, the outer shell 632 includes two shell portions 634 which are mirror images of each other. It will be appreciated that this configuration facilitates the manufacturing and assembly of the outer shell 632. Alternatively, the outer shell 632 could be made of a single, unitary piece. In yet another embodiment, the connecting arms 604, 606 may not comprise an outer shell and could only comprise the central arm member 630.

The central arm member 630 is generally straight and flat, and has an inner face 636 adapted to be oriented towards the patient support assembly 108 and an outer face 638 adapted to be oriented towards the inner face 610 of the siderail 600. The central arm member 630 includes an upper shaft 640 located at the upper end 626 of the connecting arm 604 and a lower shaft 642 located at the lower end 628 of the connecting arm 604. Specifically, the upper shaft 640 extends away from the outer face 638 of the central arm member 630 and the lower shaft 642 extends away from the inner face 636 of the central arm member 630. The upper shaft 640 defines an upper pivot axis $A_U$ and the lower shaft 642 defines a lower pivot axis $A_L$, both pivot axes $A_U$ and $A_L$ being parallel to each other and extending in a direction normal to the arm plane A (best shown in FIGS. 10, 10A and 10B). The upper shaft 640 pivotably engages the siderail 600 while the lower shaft 642 pivotably engages the motion control assembly 602. When the right foot siderail assembly 132 is assembled, the connecting arms 604, 606 are therefore disposed between the siderail 600 and the motion control assembly 602.

The siderail 600 is configured to pivot relative to the connecting arms 604, 606 about the upper pivot axis $A_U$, and the connecting arms 604, 606 are configured to pivot relative to the motion control assembly 602 about the lower pivot axis $A_L$. It will be appreciated that the footward and headward connecting arms 604, 606, the siderail 600 and the motion control assembly 602 define together a parallelogram linkage configuration. This configuration prevents the siderail 600 from pivoting about a single one of the upper pivot axes $A_U$. Instead, the siderail 600 stays in the same orientation and simply moves along an arcuate path when pivoted. It will be understood that the connecting arms 604, 606 are sufficiently spaced from each other such that they do not interfere with each other when the siderail 600 is rotated.

Figure 8:
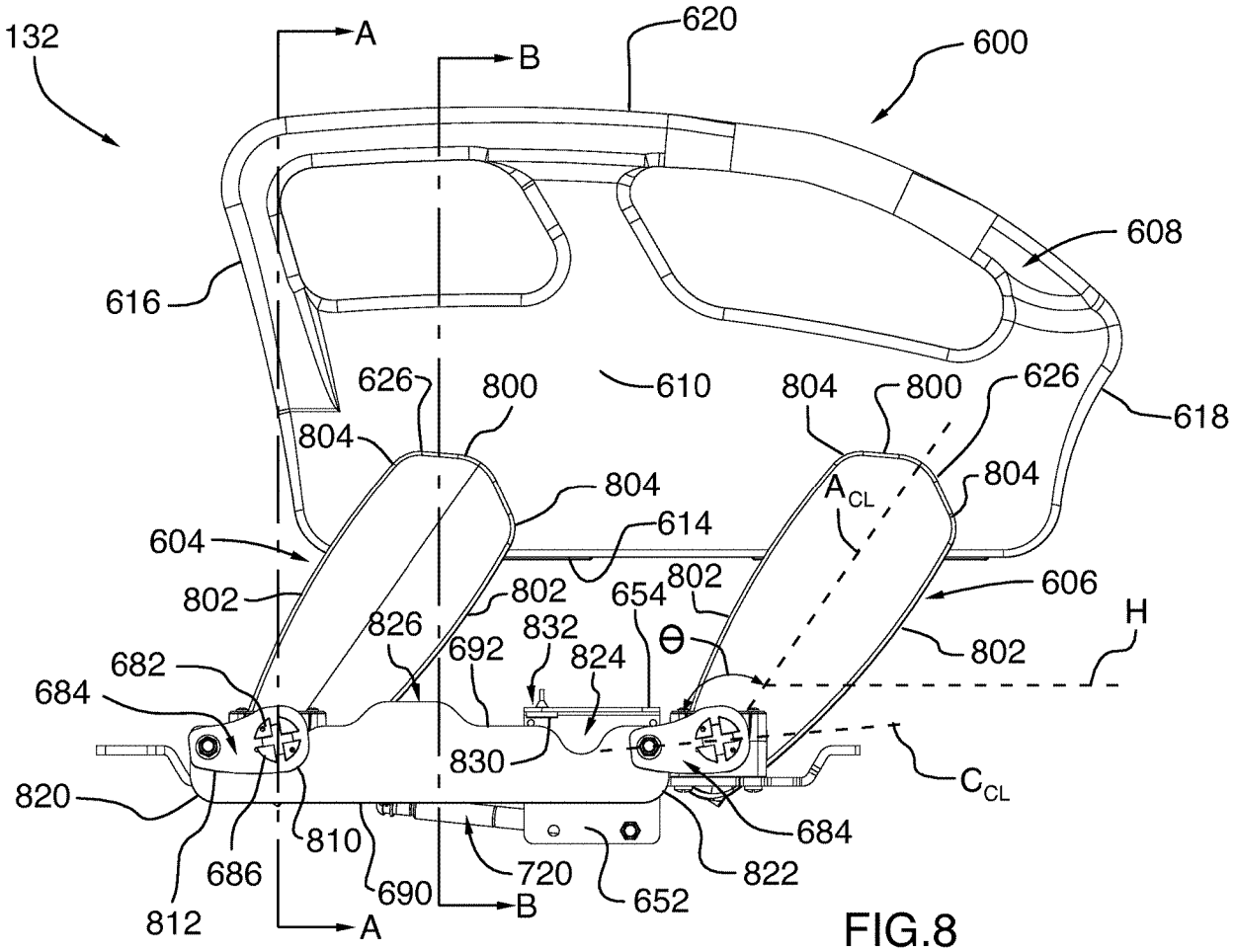
FIG. 8 is an inner side elevation view of the right foot siderail assembly illustrated in FIG. 6.
Figure 9:
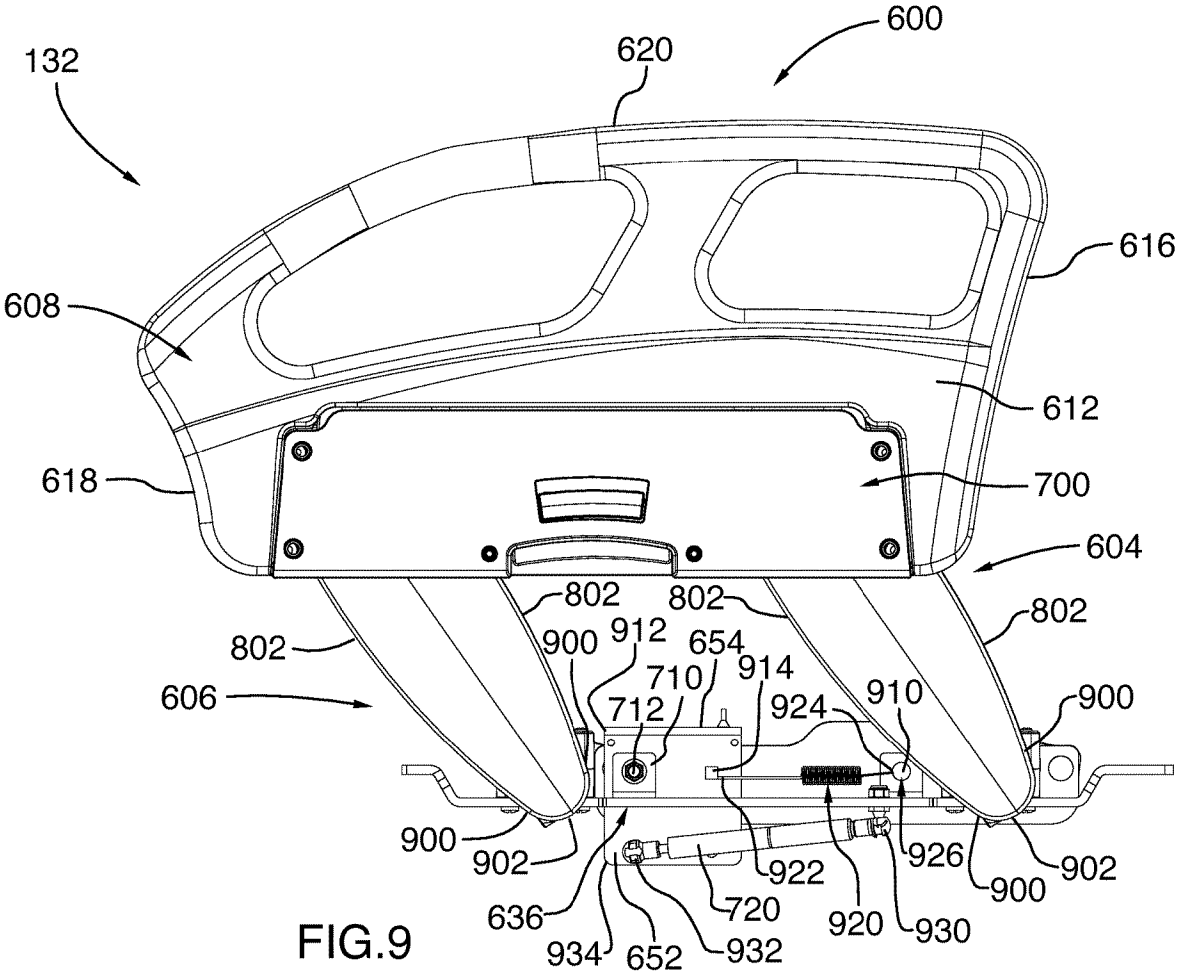
FIG. 9 is an outer side elevation view of the right foot siderail assembly illustrated in FIG. 6.

Referring specifically to FIGS. 8 and 9, the outer shell 632 of the connecting arms 604, 606 has a shape resembling that of a javelin head. Specifically, the outer shell 632 has a pointed upper edge 800, a pair of convex side edges 802, each having an upper end 804 located above the bottom edge 614 of the siderail panel 608 and a lower end 900 located near the lower shaft 642, and a hemicircular lower edge 902 connecting the side edges 802 together at their lower ends 900. The side edges 802 taper towards each other from their upper end 804 towards their lower ends 900 such that the width of the outer shell 632 decreases from the upper end 804 to the lower end 900 of the side edges 802. In this configuration, if an object such as a finger or a piece of cloth is placed in the corner between the outer shell 632 and the bottom edge 614 of the siderail panel 608, the object will tend to slide outwardly along the curved side edge 802 of the outer shell 632 rather than to get pinched between the outer shell 632 and the siderail panel 608. This may contribute in preventing injuries to the patient and to the medical personnel when using the bed 100.

In the illustrated embodiment, the motion control assembly 602 comprises an elongated mounting member or plate 636 which has a generally flat central portion 638 and raised footward and headward end brackets 640, 642. A pair of mounting holes 644 extend through both the footward and headward end brackets 640, 642 to receive fasteners for fastening the right foot siderail assembly 132 to the footward and headward right foot mounting members 508, 510 of the frame 200. More specifically, the mounting members 508, 510 are spaced apart such that the footward end bracket 640 of the mounting plate 636 is located below the front right foot mounting member 508 and the headward end bracket 642 is located below the rear right foot mounting member 510. Fasteners 550 are inserted through the mounting holes 644 and through the mounting members 508, 510 to secure the mounting plate 636 to the frame 200.

Figure 11:
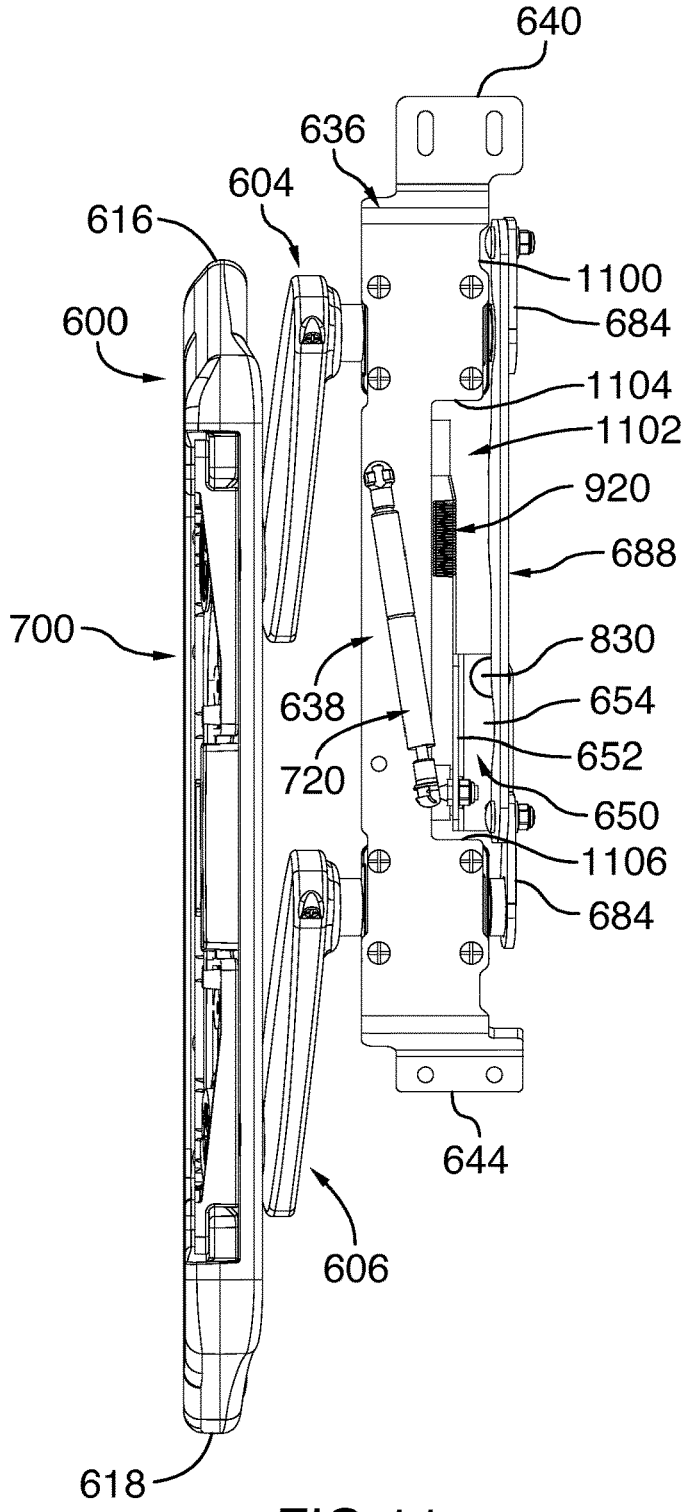
FIG. 11 is a bottom plan view of the right foot siderail assembly illustrated in FIG. 8.

Referring now to FIG. 11, the central portion 638 of the mounting plate 636 has an straight outer edge 646 located towards the siderail 600, a straight inner edge 1100 located away from the siderail 600 and a rectangular indent 1102 which extends from the inner edge 1100 towards the outer edge 646. The rectangular indent 1102 defines footward and headward abutment edges 1104, 1106 which are parallel to each other and which extend generally transversally relative to the mounting member 636.

The mounting plate 636 further includes first and second spaced-apart bracket members 710, 910 (best shown in FIG. 9) which extend upwardly from the mounting plate 636. In the illustrated embodiment, the bracket members 710, 910 are generally flat and extend generally perpendicular to the mounting plate 636 from the inner edge 1100 of the mounting plate 636.

The motion control assembly 602 further includes a pivoting plate 650 pivotably connected to the mounting plate 636. In the illustrated embodiment, the pivoting plate 650 is generally flat and has a generally L-shaped profile. Specifically, the pivoting plate 650 includes a generally rectangular lower pivoting plate portion 652 and a generally rectangular upper pivoting plate portion 654 which extends generally perpendicular to the lower pivoting plate portion 652. The pivoting plate 650 is connected to the first bracket member 710 via a pivot pin 712 which extends through the lower pivoting plate portion 652 and through the first bracket member 710. In the illustrated embodiment, the pivot pin 712 is generally off-centered relative to the lower pivoting plate portion 652. Specifically, the pivot pin extends through the pivoting plate 650 near an upper headward corner 912 of the lower pivoting plate portion 652, near the upper pivoting plate portion 654 (as best shown in FIG. 9).

As best shown in FIG. 11, the pivoting plate 650 is disposed within the rectangular indent 1102 of the mounting plate 636, near the headward abutment edge 1106. It will therefore be understood that downward pivoting of the pivoting plate 650 is limited by abutment of the lower pivoting plate portion 652 against the headward abutment edge 1106.

The pivoting plate 650 further includes a mounting hole 914 which is also off-centered relative to the lower pivoting plate portion 652. More specifically, the mounting hole 914 is located towards the second bracket member 910 and near the upper pivoting plate portion 654. A helical tension spring 920 further extends between the second bracket member 910 and the pivoting plate 650. Specifically, the tension spring 920 has a first end 922 hooked on the mounting hole 914 of the pivoting plate 650 and a second end 924 hooked on a mounting hole 926 of the second bracket member 910. In FIG. 9, the pivoting plate 650 is shown in a non-pivoted orientation in which the upper pivoting plate portion 654 is generally parallel to the mounting plate 636. The length of the tension spring 920 is selected such that the tension spring 920 biases the pivoting plate 650 towards the non-pivoted orientation when the pivoting plate 650 is pivoted away from the non-pivoted orientation, as will be further explained below.

The motion control assembly 602 further comprises a damper 720 (best shown in FIG. 9) which extends between the pivoting plate 650 and the mounting plate 636 for damping the pivoting motion of the pivoting plate 650. More specifically, the damper 720 has a first end 930 secured to the underside of the mounting plate and a second end 932 secured to a lower headward corner 934 of the lower pivoting plate portion 652.

It will be appreciated that in the configuration described above, the pivoting plate 650 acts as a lever between the pivot pin 712 and the spring 920 and between the pivot pin 712 and the damper 720, which allows linear movement of the tension spring 920 to cause pivoting of the pivoting plate 650 about the pivot pin 712 and which also allows pivoting of the pivoting plate 650 to cause linear movement of the damper 720. Alternatively, instead of a pivoting plate 650, lever arms could be provided between the pivot pin 712 and the tension spring 920 and between the pivot pin 712 and the damper 720 to accomplish this function.

The motion control assembly 602 further includes footward and headward pillow blocks 660, 662 adapted to receive the lower shaft 642 of the footward and rearward connecting arms 604, 606, respectively. In the illustrated embodiment, each pillow block 660, 662 is generally rectangular and comprises generally planar top and bottom surfaces 664, 666 which extend parallel to each other. In the illustrated embodiment, the bottom surface 666 of the pillow block is adapted to mate with a top surface 668 of the mounting plate 636 such that the pillow block 660, 662 is received on the mounting plate 636 and is attached thereto using fasteners 670.

Still in the illustrated embodiment, each pillow block 660, 662 is made of two distinct portions which are attached together, as best shown in FIG. 6A. Specifically, each pillow block 660, 662 comprises a top clamp portion 672 and a bottom clamp portion 674 adapted to be attached on the bottom clamp portion 674 with the same fasteners 670 used to attach the pillow blocks 660, 662 to the mounting plate 636. The top clamp portion 672 comprises a generally semi-cylindrical top recess 676 and the bottom clamp comprises a similar generally semi-cylindrical bottom recess 678.

The top and bottom recesses 676, 678 together define a bore 1000 (best shown in FIG. 10A) which extends all the way through the pillow block 660, 662, the bore 1000 being sized and shaped for receiving the lower shaft 642 of the corresponding connecting arm 604, 606. The top and bottom recesses 676, 678 are angled within their respective clamp portion 672, 674 such that the bore 1000 is also angled relative to the horizontal. When the lower shaft 642 is received in the bore 1000, the lower pivot axis $A_L$ is therefore angled relative to the top and bottom surfaces 664, 666 of the pillow block 660, 662. This allows the siderail 600 to move towards and away from the patient support assembly 108 as it is pivoted, as will be further explained below. In one embodiment, the lower pivot axis $A_L$ is angled relative to the top and bottom surfaces 664, 666 of the pillow block 660, 662 by an angle of 5 degrees. Alternatively, the lower pivot axis $A_L$ could be angled relative to the top and bottom surfaces 664, 666 of the pillow block 660, 662 by a an angle of 7 degrees, or by any other angle deemed by the skilled addressee to be suitable.

It will be understood that providing the pillow blocks 660, 662 in two clamp portions simplifies the mounting of the lower shaft 642 within the bore 1000 of the pillow blocks 660, 662. Alternatively, the pillow blocks 660, 662 could each be made as a single, unitary structure.

In the illustrated embodiment, the lower shaft 642 includes a first end 680 connected to the lower end 628 of the connecting arm 604, 606 and a second end 682 located away from the connecting arm 604, 606. As shown in FIG. 10, the lower shaft 642 extends through the bore 1000 of the pillow block 660, 662 such that the second end 682 of the lower shaft 642 is located beyond the pillow block 660, 662. A lever or crank 684 further extends from the second end 682 of the lower shaft 642, perpendicular to the pivot axis $A_L$ of the lower shaft 642.

Referring specifically to FIG. 8, the crank 684 is generally flat, pear-shaped and slightly asymmetrical. Specifically, each crank 684 includes a wider portion 810 which is secured to the second end 682 of the lower shaft 642 and a narrower portion 812 which is located away from the lower shaft 642. A shaft receiving opening 686 is defined in the wider portion 810 of the crank 684 to receive the second end 682 of the lower shaft 642. In the illustrated embodiment, the second end 682 of the lower shaft 642 has a cross-section generally resembling a four-leaf clover and the shaft receiving opening 814 is similarly shaped. This configuration prevents the crank 684 from rotating relative to the lower shaft 642 and allows torque to be transmitted between the crank 684 and the lower shaft 642, which allows the crank 684 to be used to stop the pivoting of the siderail 600 as will be further explained below. Alternatively, the lower shaft 642 could instead include a spline or any other configuration which allows torque to be transmitted between the crank 684 and the lower shaft 642.

Still referring to FIG. 8, the crank 684 connected at the second end 682 of the lower shaft 642 is angled relative to the corresponding connecting arm 604, 606 connected at the first end 680 of the lower shaft 642. Specifically, a centerline of the crank $C_{CL}$ is angularly offset relative to the centerline $A_{CL}$ of the connecting arm 604, 606. In the illustrated embodiment, the crank 684 is angularly offset relative to the connecting arm 604, 606 by an angle θ of 132 degrees. This angular offset angle θ is selected to allow the motion control assembly 602 to limit the siderail 600 to a predetermined path having a predetermined length when the siderail 600 is pivoted, as will become apparent below.

Referring now to FIGS. 6A and 8, the motion control assembly 602 further comprises an abutment member 688 extending between the lower shafts 642 of the connecting arms 604, 606. Specifically, the abutment member 688 is generally flat and has a generally straight lower edge 690 and a profiled upper edge 692 which is sized and shaped to allow the upper edge to cooperate with the pivot plate 650 in order to limit the pivoting of the siderail 600, as will be further explained below.

In the illustrated embodiment, the abutment member 688 comprises a footward end 820 pivotably connected to the crank 684 of the footward connecting arm 604 and a headward end 822 pivotably connected to the crank 684 of the headward connecting arm 606. As best shown in FIG. 10, the abutment member 688 is disposed between the cranks 684 and the pillow boxes 660, 662. The upper edge 692 of the abutment member comprises footward and headward semicircular indents 824 which are located respectively near the footward and headward ends 820, 822 of the abutment member 688. The semicircular indents are sized and shaped to receive the second end of the lower shaft 642 when the siderail 600 is pivoted until the abutment member 688 abuts the lower shaft 642. In one embodiment, when the siderail 600 is in the raised position, the abutment member 688 abuts the lower shaft 642 of one of the footward and headward connecting arms 604, 606, and when the siderail 600 is in the lowered position, the abutment member 688 abuts the lower shaft 642 of the other one of the footward and headward connecting arms 604, 606, as will become apparent below. In this configuration, the abutment member 688 acts as a stop to limit the pivoting of the siderail 600 to a predetermined path having a predetermined length, defined between the raised position and the lowered position.

The upper edge 692 of the abutment member 688 further comprises a raised portion 826 located between the front and rear semicircular indents 824. In the illustrated embodiment, the raised portion 826 is located towards the footward connecting arm 604. The raised portion 826 is configured to cooperate with the pivoting plate 650 to dampen the pivoting of the siderail 600 from the raised position to the lowered position as it gets near to the lowered position. Specifically, the upper pivoting plate portion 654 extends away from the mounting plate 636 and above the abutment member 688, and a bumper 830 is secured to the underside of the upper pivoting plate portion 654. In the illustrated embodiment, the bumper 830 is generally circular and is secured through a bumper mounting hole 832 defined in the upper pivoting plate portion 654. Alternatively, the bumper 830 could have any other shape, and could be simply glued to the underside of the upper pivoting plate portion 654 or secured using any other technique known to the skilled addressee.

When the siderail 600 is pivoted towards the lowered position and slightly before the siderail 600 reaches the lowered position, the raised portion of the abutment member 688 abuts the bumper 830 and causes the pivoting plate 650 to pivot upwardly about the pivot pin 712. As explained above, the pivoting of the pivoting plate 650 causes linear movement of the damper 720, which dampens the pivoting of the pivoting plate 650, thereby also dampening the movement of the abutment member 688 and therefore of the siderail 600 as well. This configuration prevents the siderail 600 from coming to an abrupt stop when it reaches the lowered position, which may damage the siderail assembly as well as cause discomfort to the patient lying on the bed 100.

In one embodiment, the bumper 830 is made of elastomeric material such as rubber. Alternatively, the bumper 830 could be made of any other material deemed by the skilled addressee to be suitable.

Figure 9A:
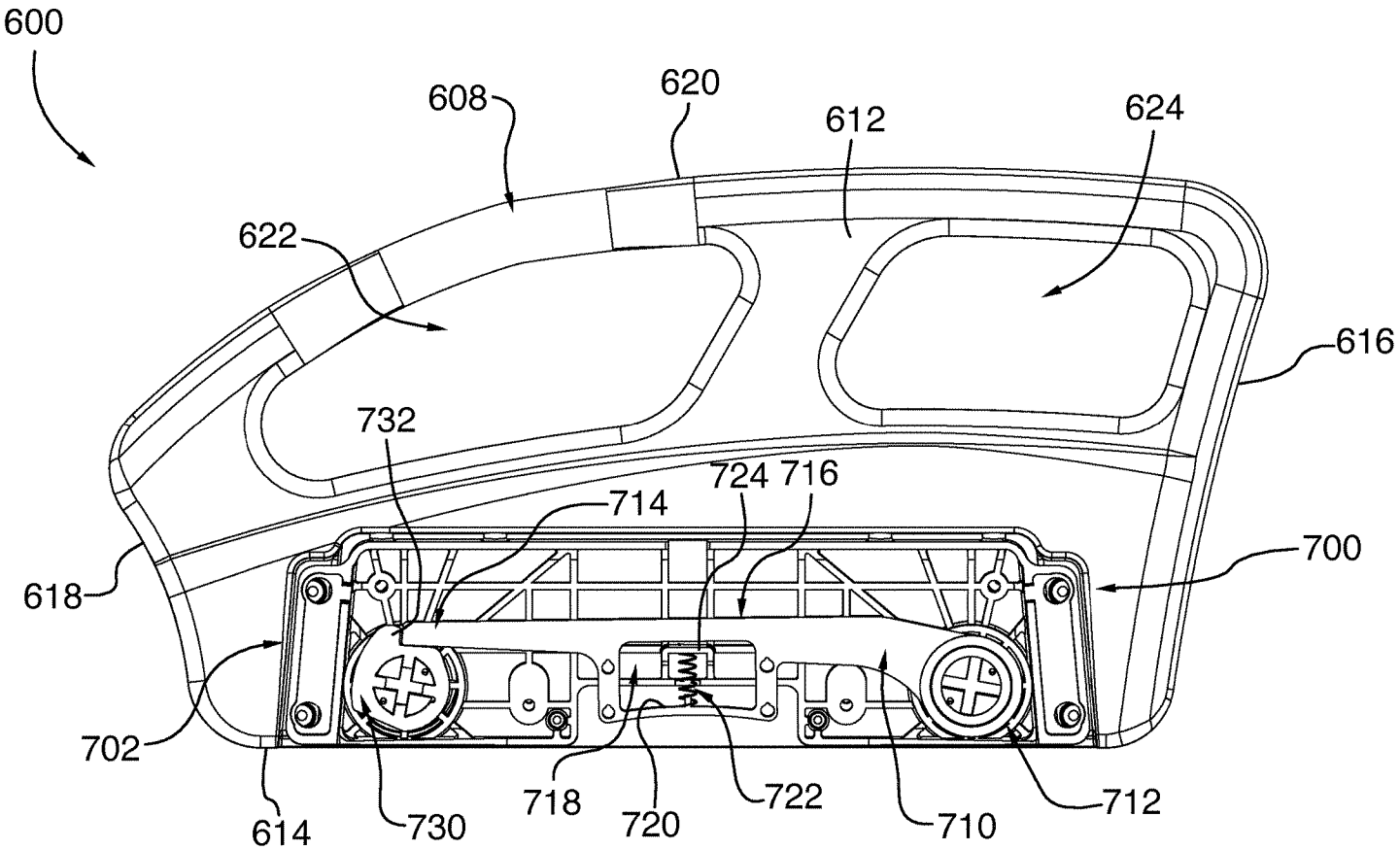
FIG. 9A is an outer side elevation view of a siderail of the right foot siderail assembly illustrated in FIG. 9, with the cover and handle removed to show details of the locking assembly.

Now referring to FIGS. 7A and 9A, the locking assembly 700 will now be described. The locking assembly 700 comprises a generally rectangular housing 702 sized and shaped to be received in a corresponding rectangular recess 703 defined in the siderail panel 608, and a cover 704. A pair of circular openings 706 are provided in the siderail panel 608 and a corresponding pair of circular openings 708 are provided in the housing 702 in alignment with the circular openings of the siderail panel 608 to allow the upper shafts 640 of the connecting arms 604, 606 to extend through the siderail panel 608 and into the housing 702. The locking assembly 700 further comprises a pawl member 710 which is generally flat and has a base portion 712 connected to the upper shaft of the footward connecting arm 604, a free end 714 and a central portion 716 extending between the base portion 712 and the free end 714. The base portion 712 is generally annular and is mounted to fit on the upper shaft 640. It will be understood that the pawl member 710 is not locked in rotation with the upper shaft 640 of the footward connecting member 604, but is instead allowed to rotate freely around the upper shaft 640.

The central portion 716 of the pawl member 710 includes a rectangular opening 718 which has an inner sidewall 720. The locking assembly 700 further comprises a helical compression spring 722 which biases the pawl member 710 downwardly. More specifically, the housing 702 comprises a projection 724 which extends through the rectangular opening 718 of the pawl member 710, and the compression spring 722 extends between the inner sidewall 720 of the rectangular opening 718 and the projection 724. The locking assembly 700 further comprises a handle 726 which is secured to the underside of the central portion 716 of the pawl member 710. The housing 702 and the cover 704 both include corresponding downwardly-facing rectangular indents 728 which provide access to the handle 726. When the handle 726 is pushed upwardly by a user, the pawl member 710 is pivoted upwardly about the upper shaft 640. Simultaneously, the compression spring 722 is compressed between the inner sidewall 720 of the pawl member 710 and the projection 724 of the housing 720. When the handle 726 is released, the pawl member 710 is pivoted back down to its initial position by the compression spring 722.

The locking assembly 700 further comprises a wheel member 730 mounted to the upper shaft 640 of the headward connecting arm 606. The wheel member 730 is locked in rotation with the upper shaft 640 such that rotation of the upper shaft 640 causes the wheel member 730 to rotate as well. The wheel member 730 comprises a tooth 732 which projects outwardly from the wheel member 730. The wheel member 730 is configured such that the locking assembly 700 is in a locked position when the siderail 600 is in the raised position, in which the tooth 732 abuts the free end 714 of the pawl member 710 to prevent pivoting of the upper shaft 640 of the headward connecting arm 606 relative to the siderail 600, which prevents the entire siderail 600 from pivoting.

The locking assembly 700 is unlocked by pushing the handle 726 upwardly. Specifically, the pawl member 700 is pivoted upwardly such that its free end 714 is raised above the tooth 732, which allows the upper shaft 640 of the headward connecting arm 606 to pivot relative to the siderail 600 and therefore allows the siderail 600 to pivot from the raised position towards the lowered position.

In the illustrated embodiment, the locking assembly 700 further comprises a indicator which provides an indication of whether the locking assembly 700 is in the locked position or the unlocked position. Specifically, the cover 704 comprises a window 734 located above the indent 728 of the cover 704 to allow visual access inside the housing 702. Through the window 734, the user can see the handle 726 which provides a visual indication that the locking assembly 700 is locked or unlocked. In one embodiment, the handle 726 could comprise a lower portion which is in a predetermined color and which is masked by the cover 704 between the indent 728 and the window 704 when the locking assembly 700 is in the locked position. When the handle 726 is pushed up, the lower portion of the handle 726 becomes aligned with the window 734 and the color becomes visible to the user or to anyone looking at the window 734. Instead of a predetermined color, the indicator could include a reflective element or a light source. Alternatively, the pawl member 710 itself could be directly visible through the window 734. In this case, the user could simply see the position and/or angle of the pawl member through the window and thereby determine if the locking assembly 700 is in a locked or unlocked position.

Alternatively, another type of visual indication could be provided to the user, for example a marker having a predetermined color associated with the locked position which is only visible when the handle 726 is not raised. In another embodiment, instead of a color, a symbol could be shown corresponding to the current status of the locking assembly 700. In yet another embodiment, the indicator could produce a sound or any other type of indication instead of a visual indication. In yet another embodiment, the handle 726 and/or the pawl member 710 could be operatively coupled to a sensor, which could be operatively connected to the control interface and could thereby provide an indication of whether the locking assembly 700 is in the locked position or the unlocked position through the control interface.

Figure 12:
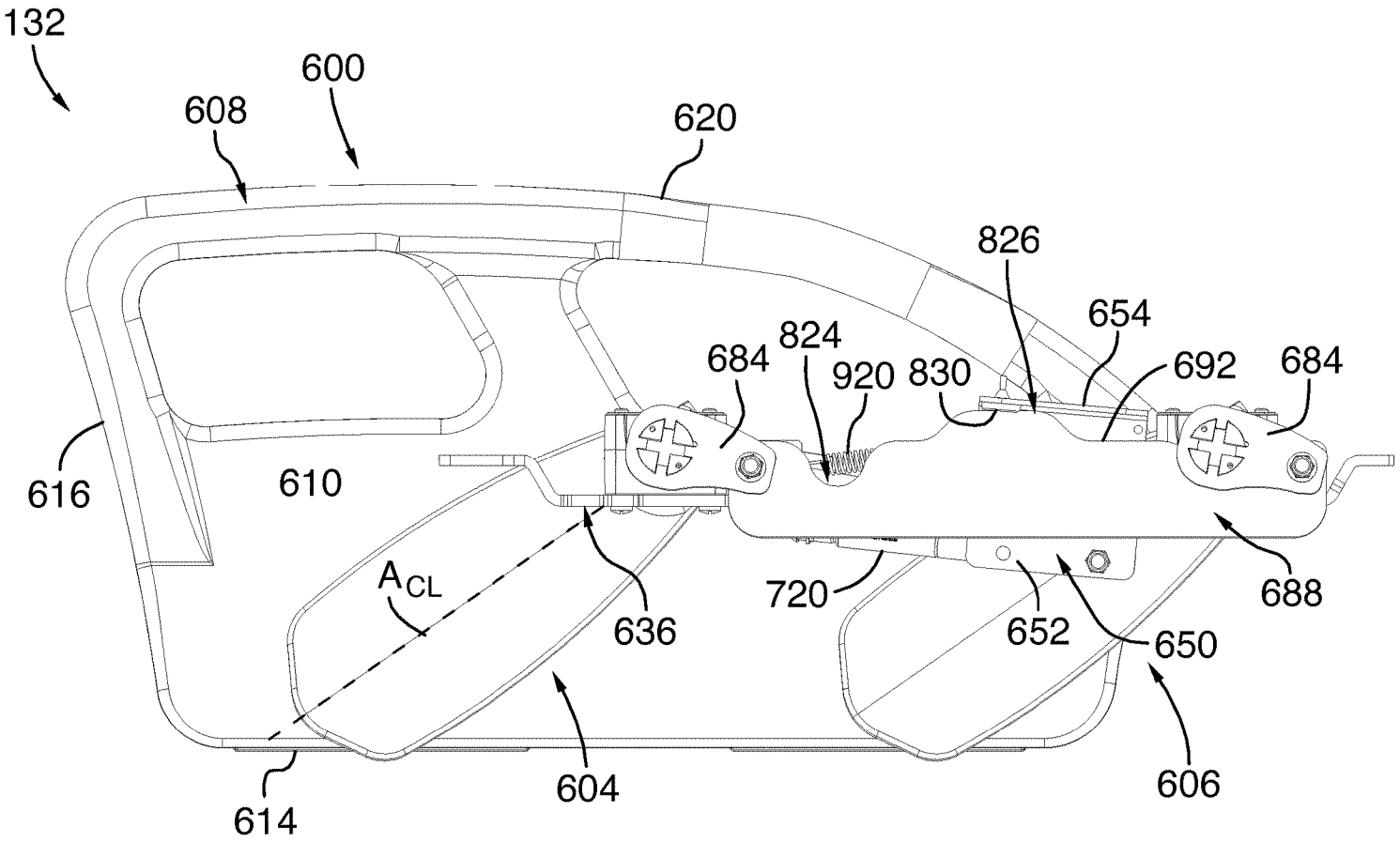
FIG. 12 is an inner elevation view of the right foot siderail assembly similar to that illustrated in FIG. 8, except that the siderail is shown in the lowered position.

Operation of the right foot siderail assembly 132 will now be described in accordance with one embodiment, with reference to FIGS. 8, 12 and 13. It will be appreciated that since the left and right foot siderail assemblies 130, 132 are mirror images of each other, the operation of the left foot siderail assembly 130 is similar to that of the right foot siderail assembly 132.

In the illustrated embodiment, the siderail 600 of the right foot siderail assembly 132 is initially in the raised position. As best seen in FIG. 8, the connecting arms 604, 606 are not vertical when the siderail 600 is in the raised position, but are at an angle of less than 90 degrees relative to the horizontal. In the illustrated embodiment, the centerlines $A_{CL}$ of the connecting arms 604, 606 are at angle of 55 degrees relative to a horizontal plane H when the siderail 600 is in the raised position. This configuration prevents the siderail 600 from being inadvertently pivoted from the raised position to the lowered position by a slight bump from the patient or from medical personnel, especially if the locking assembly 700 is left in the unlocked position or malfunctions. In the present configuration, a slight movement of the siderail 600 from the raised position to the lowered position (i.e. a movement that does not cause the siderail 600 to pivot beyond an angle of 90 degrees relative to the horizontal) would not cause the siderail 600 to pivot all the way to the lowered position, because the siderail 600 would pivot back to the raised position under its own weight.

To move the siderail 600 from the raised position to the lowered position, the user first pushes the handle 726 of the locking assembly 700 upwardly. It will be appreciated that in the illustrated embodiment, the handle 726 is located towards the outer face 612 of the siderail 600, and is therefore easily accessible to a user standing next to the bed 100 but would be more difficult to reach for a patient lying on the bed 100. This may help to prevent certain patients from lowering the siderail 600 and exiting the bed without proper supervision.

It will be appreciated that once the siderail 600 is pivoted such that the tooth 732 of the wheel member 730 has moved beyond the free end 714 of the pawl member 710, the user may release the handle 726 and the locking assembly 700 will remain in the unlocked position.

Once the locking assembly 700 is unlocked, the siderail 600 may be pivoted towards the lowered position. Specifically, the user may manually push the siderail 600 laterally in the siderail plane P to pivot the siderail 600 at least until the centerline $A_{CL}$ of the connecting arms 604, 606 defines an angle of 90 degrees relative to the horizontal plane H. The user may then keep pushing the siderail 600, or may let go of the siderail 600 which will continue to pivot towards the lowered position under its own weight.

Figure 13:
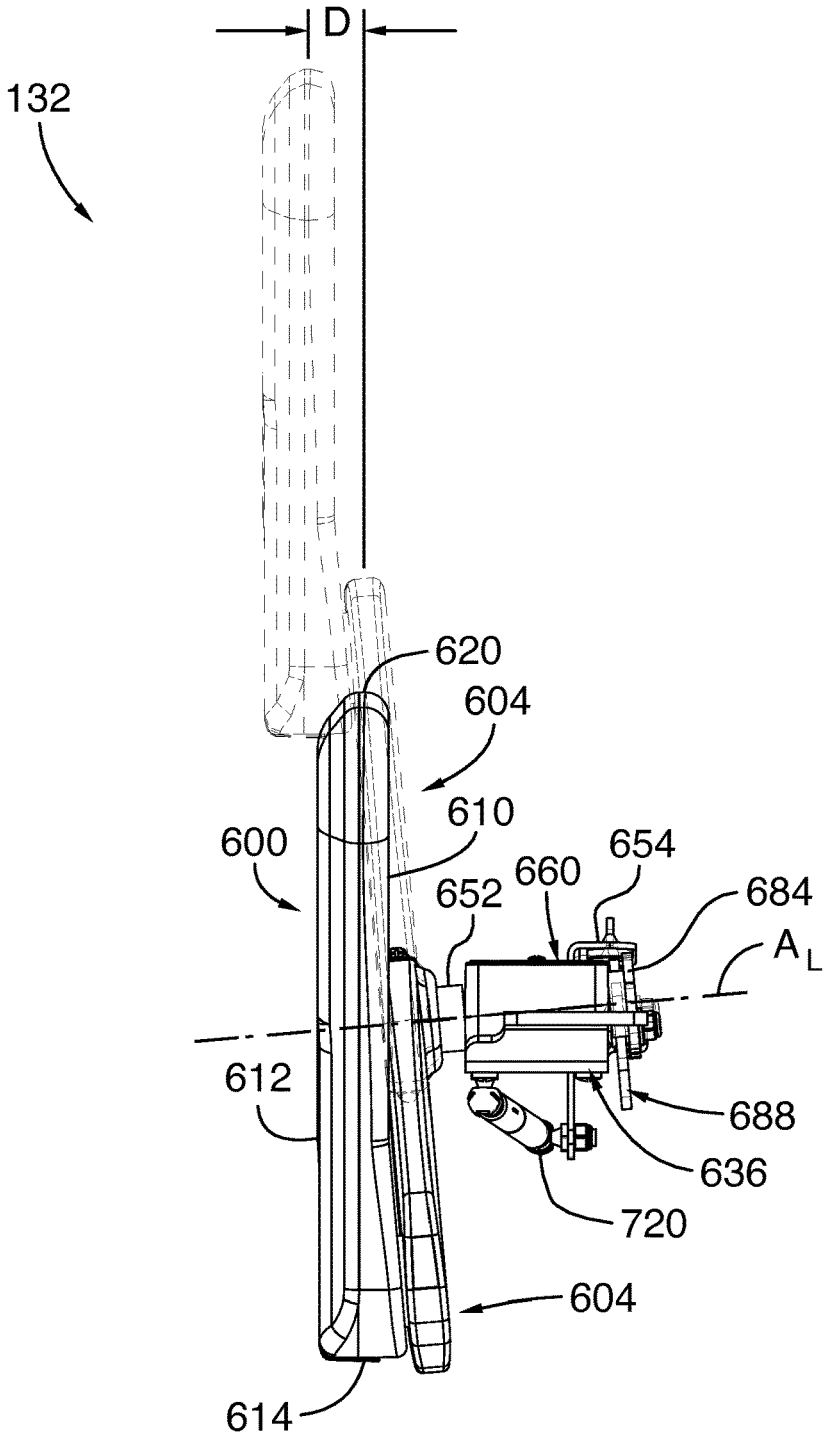
FIG. 13 is a longitudinal, side elevation view of the right foot siderail assembly illustrated in FIG. 6, the siderail in raised position drawn in dashed lines and the siderail in the lowered position shown in solid lines to illustrate the inward displacement of the siderail during pivoting thereof.

Since the lower pivot axis $A_L$ of the lower shafts 642 is angled relative to the mounting plate 636, the siderail 600 is also moved inwardly towards the patient support assembly 108 as the siderail 600 is pivoted, as best shown in FIG. 13. In one embodiment, the lower pivot axis $A_L$ is angled at an angle of 5 degrees below the horizontal, and the siderail 600 moves inwardly towards the patient support assembly 108 by a distance D of 1 1/16 inches or 2.7 cm when the siderail 600 is fully pivoted from the raised position to the lowered position. However, the siderail panel 608 remains in the same orientation. Specifically, the siderail plane P remains perpendicular to the mounting plate 636. Alternatively, the lower pivot axis $A_L$ could be angled at a different angle below the horizontal, and the siderail 600 could be moved inwardly towards the patient support assembly 108 by a different distance D.

This configuration allows the patient lying on the patient support surface 250 to enjoy increased space widthwise between the siderails 600 while still allowing medical personnel to stand close to the bed 100 when the siderails 600 are in the lowered position to have access to the patient support assembly 108 and/or to the patient lying on the patient support assembly 108.

Furthermore, slightly before the siderail 600 reaches the lowered position, the raised portion 826 of the abutment member 688 abuts the bumper 830 of the pivot plate 650. The pivot plate 650 thereby pivots slightly upwardly. As explained above, this moves the damper 720 linearly and extends the tension spring 920. The pivoting of the siderail 600 is therefore damped as it comes to a stop at the lowered position to prevent damage to the bed 100 and to prevent the siderail 600 from producing undesirable loud noise and/or vibrations as explained above.

In the illustrated embodiment, the siderail 600 may pivot until the lower shaft 642 of the headward connecting arm 606 is received in the corresponding semi-circular indent 824 of the abutment member 688. In this position, the abutment member 688 abuts the lower shaft 642, thereby preventing further pivoting of the siderail 600, and the abutment member 688 is maintained in abutment against the lower shaft 642 by the weight of the siderail 600. Alternatively, instead of being limited by the abutment member 688, the pivoting of the siderail 600 may be limited by a stop member located elsewhere on the right foot siderail assembly 132, on the frame 200 or on the patient support assembly 108.

To pivot the siderail 600 from the lowered position towards the raised position, the user simply pulls the siderail 600 up in the opposite direction along its travel path until the connecting arms 604, 606 pivots beyond an intermediate position in which their centerline $A_{CL}$ are at an angle of 90 degrees relative to the horizontal. The user can then continue to push the siderail 600 towards the raised position or can let go of the siderail 600, which will pivot towards the raised position under its own weight.

It will be appreciated that during this movement, the abutment member 688 moves away from the upper pivoting plate portion 654 of the pivoting plate 650. When the abutment member 688 no longer abuts the pivoting plate 650, the tension spring 920 urges the pivoting of the pivoting plate 650 back towards its original orientation. As the pivoting plate 650 is pivoted back to its original orientation, the damper 720 is also moved back into its original, non-extended position.

When the siderail 600 reaches the raised position, the locking assembly 700 is moved back into the locked position. More specifically, the wheel member 730 is rotated until the free end 714 of the pawl member 710 is urged back into engagement with the tooth 732 of the wheel member 730. The siderail 600 is thereby prevented from pivoting back towards the lowered position until the locking assembly 700 is unlocked again.

In one embodiment, as the siderail 600 is pivoted near the raised position, the abutment member 688 is again brought in abutment against the bumper 830 to dampen the pivoting of the siderail 600 as it comes to a stop at the raised position. Alternatively, dampening of this movement may not be required or desired, especially if the siderail 600 only travels a relatively small vertical distance between a position in which the centerlines $A_{CL}$ of the connecting arms 604, 606 are at an angle of 90 degrees relative to the horizontal and the raised position.

Figure 14:
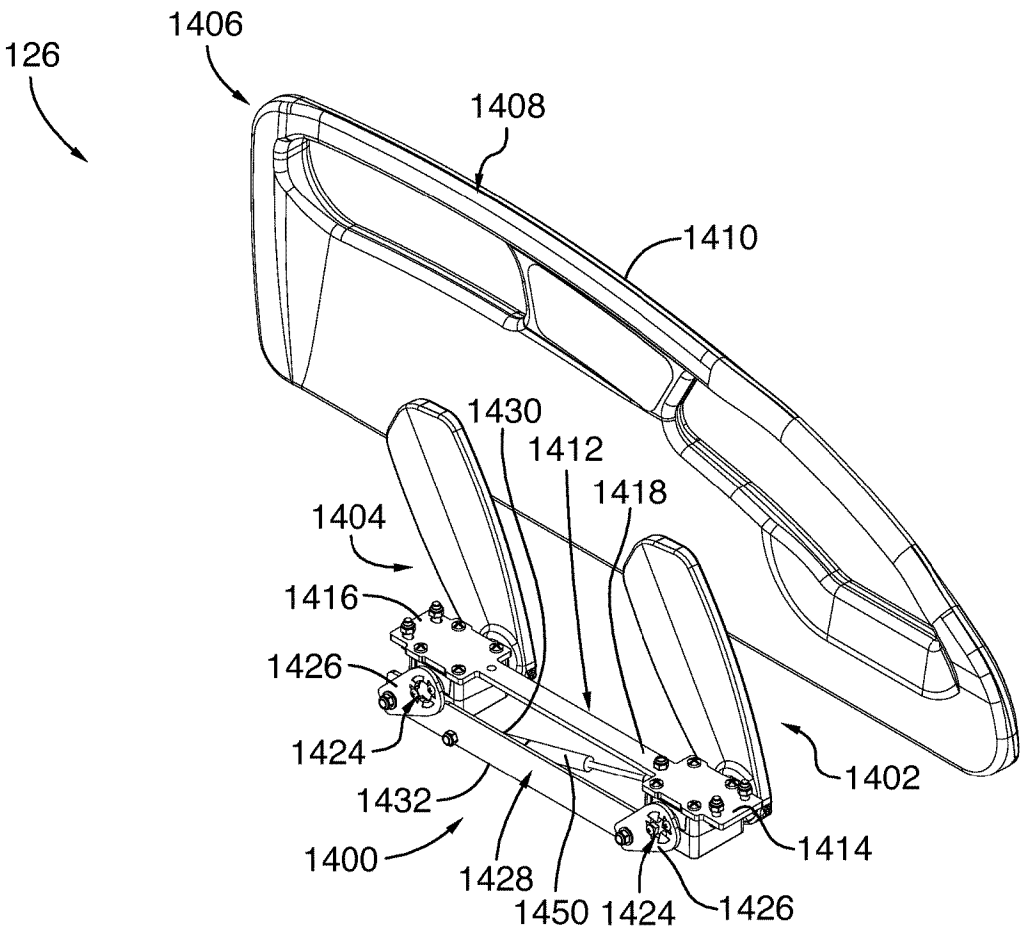
FIG. 14 is a top inner perspective view of a left head siderail assembly of the hospital bed illustrated in FIG. 1, with the siderail in the raised position.
Figure 14A:
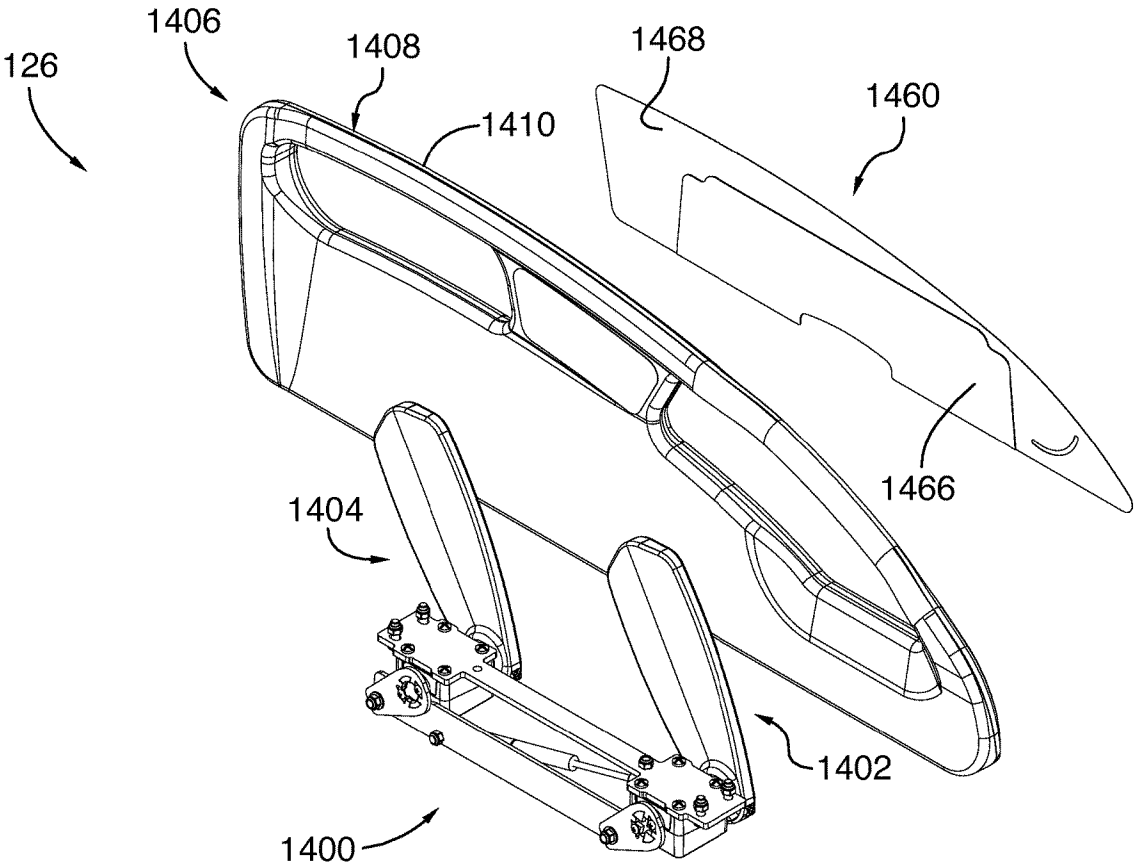
FIG. 14A is a top inner perspective view of the left head siderail assembly illustrated in FIG. 14, with the siderail partially exploded to show the membrane.
Figure 14B:
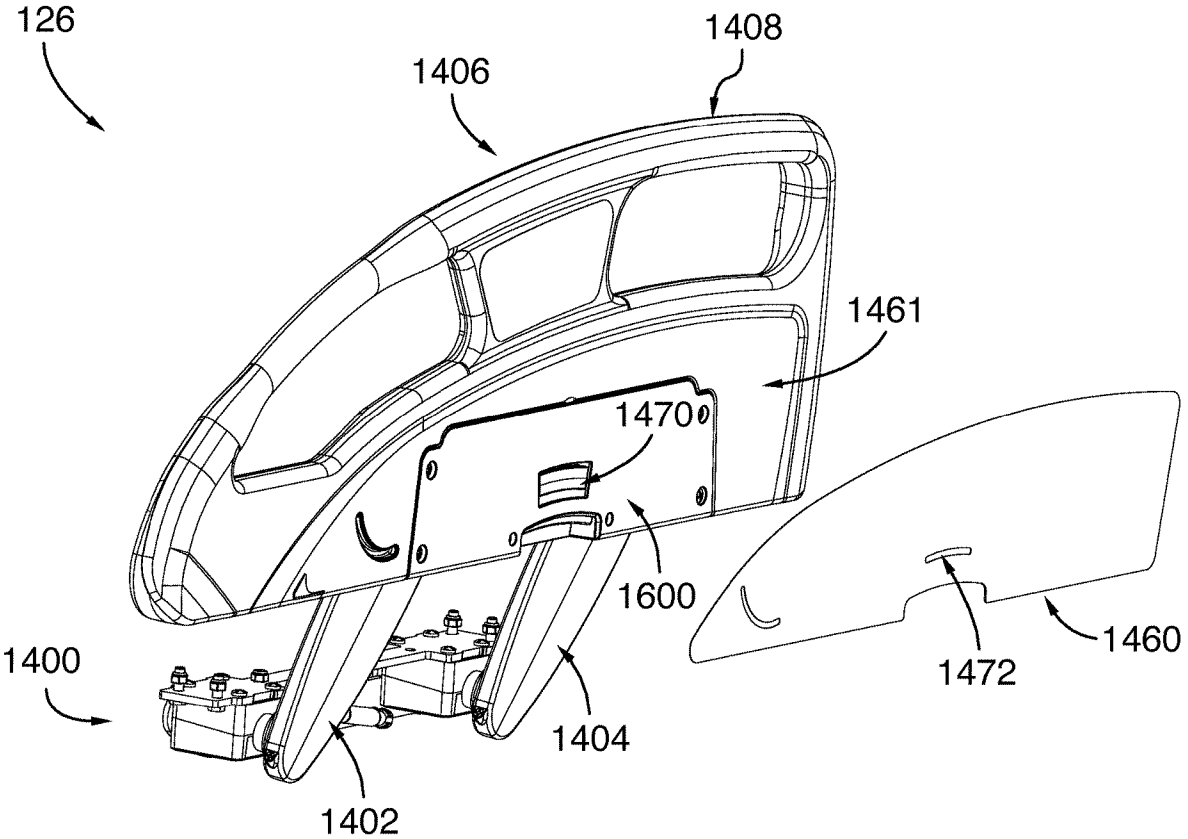
FIG. 14B is a top outer perspective view of the left head siderail assembly illustrated in FIG. 14A.
Figure 15:
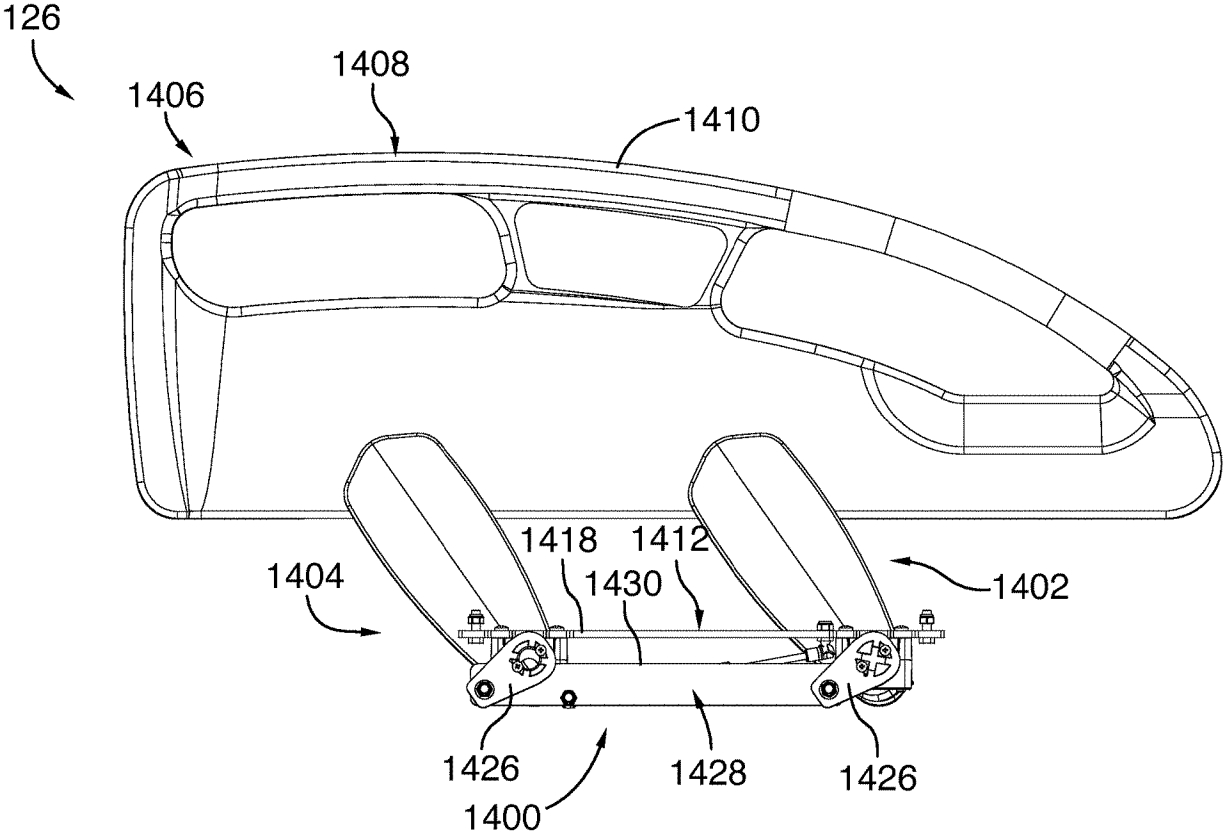
FIG. 15 is an inner elevation view of the left head siderail assembly illustrated in FIG. 14.
Figure 16:
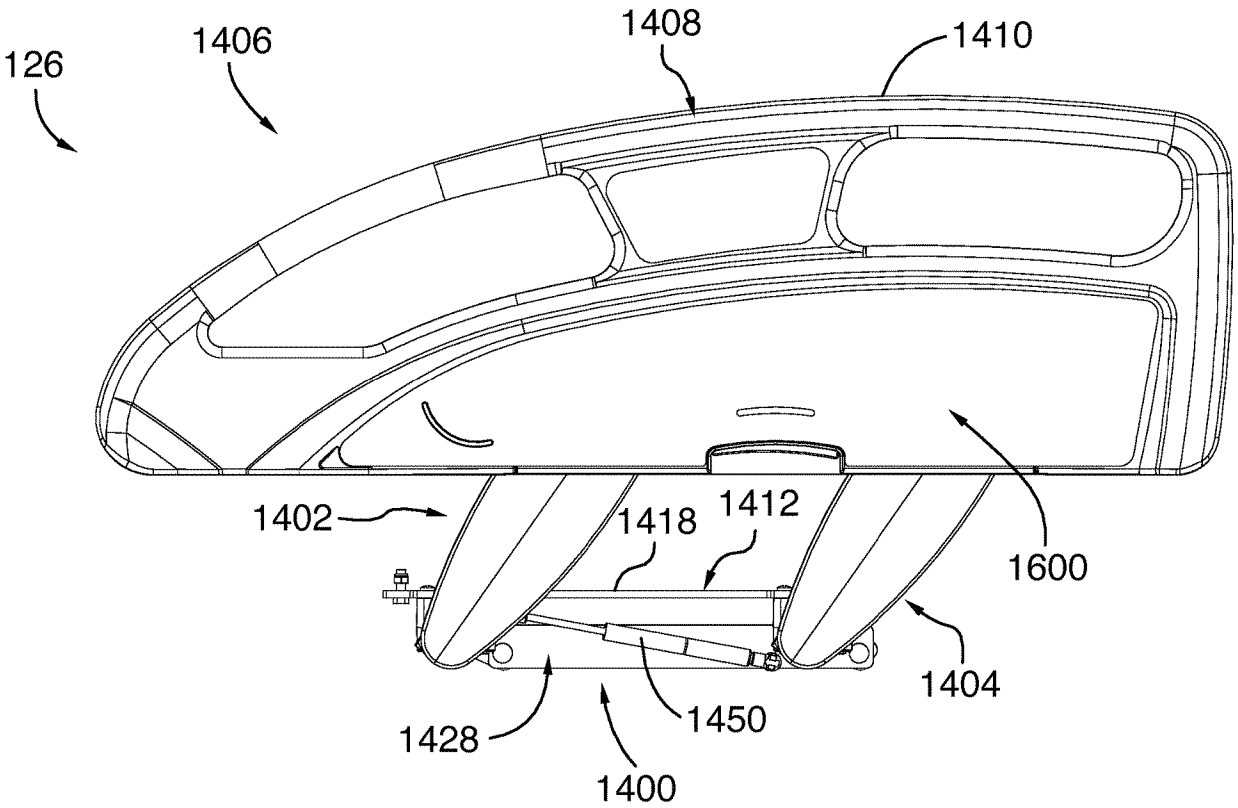
FIG. 16 is an outer elevation view of the left head siderail assembly illustrated in FIG. 14.

Now turning to FIGS. 14 to 16, the left head siderail assembly 126 will now be described. The same description applies to the right head siderail assembly 128, which is a mirror image of the left head siderail assembly 126.

Similarly to the right foot siderail assembly 132, the left head siderail assembly 126 comprises a motion control assembly 1400 configured to be mounted to the patient support assembly 108, footward and headward connecting arms 1402, 1404 pivotably connected to the motion control assembly 1400 and a siderail 1406 pivotably connected to the connecting arms 1402, 1404.

The siderail 1406 includes a siderail panel 1408 and a locking assembly 1600 (shown in FIG. 16) similar to the locking assembly 700 of the right foot siderail assembly 132, which can be moved from a locked position in which pivoting of the siderail 1406 is prevented and an unlocked position in which the siderail 1406 is allowed to pivot between a raised position and a lowered position.

The siderail panel 1408 of the left head siderail assembly 126 is substantially longer than the siderail panel 608 of the right foot siderail assembly 132. Furthermore, the siderail panel 1408 has a top edge 1410 which curves down towards the foot end 104 of the bed 100 rather than towards the head end 102 of the bed 100, as is the case with the siderail panel 608 of the right foot siderail assembly 132. Alternatively, the siderail panel 1408 of the left head siderail assembly 126 could be similar to the siderail panel 1408 of the right foot siderail assembly 132, or have any other shape deemed by the skilled addressee to be suitable.

In the illustrated embodiment, the motion control assembly 1400 comprises an elongated mounting plate 1412 which is generally dumbbell-shaped. Specifically, the mounting plate 1412 includes generally rectangular footward and headward end portions 1414, 1416 and a narrower central portion 1418 extending between the footward and headward end portions 1414, 1416. The motion control assembly 1400 further comprise footward and headward pillow blocks 1420, 1422 secured to the underside of the mounting plate 1412 under the footward and rearward end portions 1414, 1416, respectively. The pillow blocks 1420, 1422 are substantially similar to the pillow blocks 660, 662 described above in connection with the embodiment of the left foot siderail assembly 132. The pillow blocks 660, 662 are adapted to receive lower shafts 1424 of the connecting arms 1402, 1404 which extend through the pillow blocks. Cranks 1426, similar to the cranks 684 of the right foot siderail assembly 132, are secured to the lower shafts 1424 and an abutment member 1428 extends between and is connected to the cranks 1426. The abutment member 1428 includes top and bottom edges 1430, 1432 which are both generally straight and extend parallel to each other. The top edge 1430 of the abutment member 1428 abuts one of the lower shafts 1424 when the siderail 1406 is in the lowered position to prevent further pivoting of the siderail 1406.

In the illustrated embodiment, the motion control assembly 1400 does not comprise a pivoting plate such as the pivoting plate 650 of the right foot siderail assembly 132. Instead, the motion control assembly 200 comprises a damper 1450 which extends between and is connected to the mounting plate 1412 and the abutment member 1428. In this configuration, the entire pivoting motion of the siderail 1406 between the raised position and the lowered position is damped by the damper 1450.

When the siderail 1406 of the left head siderail assembly 126 is in the raised position, the connecting arms 1402, 1404 are angled such that, to pivot from the raised position to the lowered position, the siderail 1406 does not pass by an intermediate position in which the centerline of the connecting arms are at an angle of 90 degrees relative to the horizontal. In this configuration, when a user unlocks the locking assembly 1600, the siderail 1406 immediately starts to pivot towards the lowered position under its own weight and stops when the abutment member 1428 abuts the lower shaft 1424. Alternatively, the connecting arms 1402, 1404 of the left head siderail assembly 126 could be configured to pivot similarly to the left and right foot siderail assemblies 130, 132. Specifically, the connecting arms 1402, 1404 of the left head siderail assembly 126 could be oriented towards the left foot siderail assembly 130 and configured to pass through an intermediate position in which the centerline of the connecting arms are at an angle of 90 degrees relative to the horizontal before coming to rest at a lowered position away from the left foot siderail assembly 130.

Figure 17:
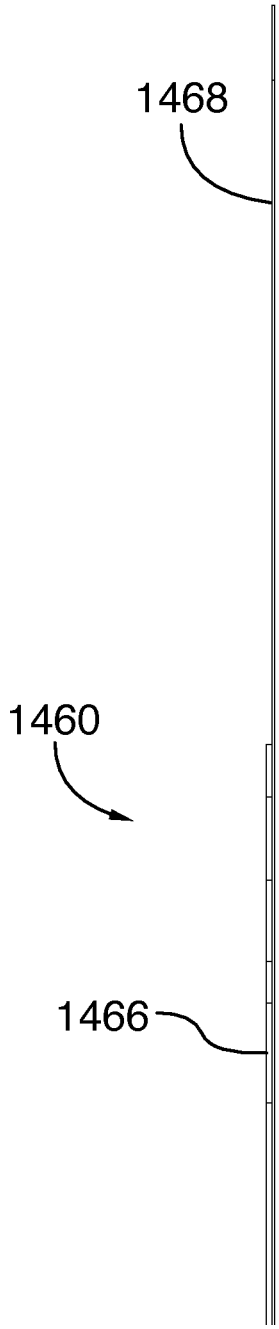
FIG. 17 is a side elevation view of the membrane of the left head siderail assembly illustrated in FIGS. 14A and 14B.

In the illustrated embodiment, the left head siderail assembly 126 further comprises a membrane 1460 secured to the siderail panel 1408 and disposed over the locking assembly 1600. Specifically, the siderail panel 1408 has an inner face 1462 located towards the motion control assembly 1400 and an outer face 1464 located away from the motion control assembly 1400. The outer face 1464 includes a recess 1461 which is sized and shaped for receiving the membrane 1460. In the illustrated embodiment, the membrane 1460 includes a central portion 1466 and a peripheral portion 1468 which is thinner than the central portion 1466, as shown in FIG. 17. Specifically, the central portion 1466 is sized and shaped to cover the locking assembly 1600 mounted in the siderail panel 1408. In this configuration, if the top face of the locking assembly 1600 is not flush with the outer face 1464 of the siderail panel 1408 and is depressed slightly inwardly into the siderail panel 1408, the central portion 1466 will take up the additional space to prevent empty spaces to be formed under the membrane 1460, which may form an ideal environment for pathogens to proliferate. The central portion 1466 may also contribute in providing a substantially flat and even surface and in reducing deformation at the interface between different components on the outer face 1464, while the peripheral portion 1468 allows good flexibility which may be desirable if, for example, keypads are integrated into the siderail panel 1408. Furthermore, since the peripheral portion 1468 is relatively thin, the interface between the membrane 1460 and the outer face 1464 is relatively easy to clean and does not create an area where dirt and pathogens may accumulate.

In one embodiment, the membrane 1460 is opaque, but alternatively, the membrane 1460 could be translucent or transparent. In one embodiment, the central portion 1466 has a thickness of about 1.5 to 2 mm, and the peripheral portion 1468 has a thickness of about 0.25 mm. Alternatively, the central and peripheral portions 1466, 1468 of the membrane 1460 could have different thicknesses.

In the illustrated embodiment, the locking assembly 1600 comprises a first window 1470 and the membrane 1460 comprises an second window 1472 which is aligned with the first window 1470. In one embodiment, the second window 1472 is transparent and is located in the central portion 1466 of the membrane 1460 which is opaque. Alternatively, the second window 1472 could also comprise an opening defined in the membrane 1460. The second window 1472 is adapted to allow a user to see through the first window of the locking assembly 1600 an indication of whether the locking assembly is locked or unlocked.

It will be appreciated that a similar membrane could be provided on some or all of the other siderail assemblies 128, 130, 132.

Figure 18:
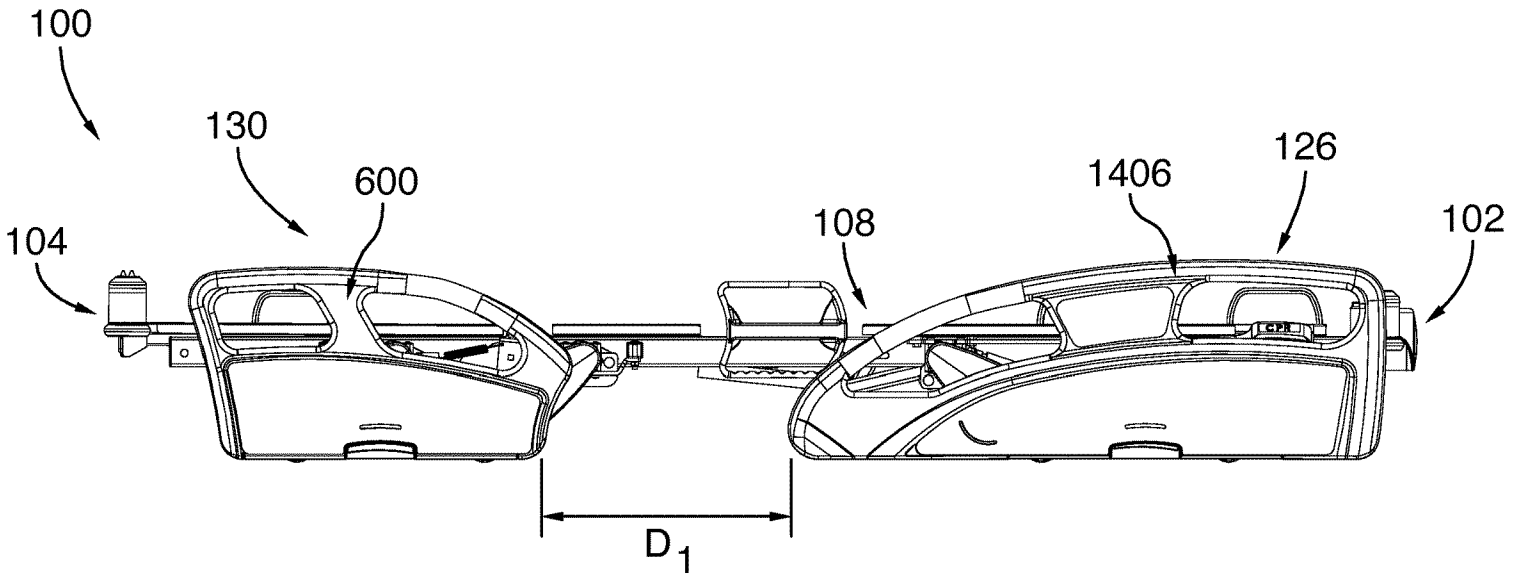
FIG. 18 is a left side elevation view of the patient support assembly illustrated in FIG. 2, with the siderails of the left foot siderail assembly and of the left head siderail assembly both moved in their respective lowered positions.

Referring now to FIG. 18, when both the head and foot siderails on a same side of the bed 100 are in the lowered position, the bed 100 provides sufficient space between the head and foot siderails to allow the patient to comfortably get in and out of the bed 100 and to sit on the edge of the bed 100. For example, when the siderail 1406 of the left head siderail assembly 126 and the siderail 600 of the left foot siderail assembly 130 are both in the lowered position, they are spaced from each other by a distance $D_1$ of 16.9 inches or 42.93 cm. Alternatively, the siderail 1406 of the left head siderail assembly 126 and the siderail 600 of the left foot siderail assembly 130 could be spaced from each other by a different distance $D_1$.

It will also be appreciated that in the configuration illustrated in FIG. 18, the siderail 1406 of the left head siderail assembly 126 and the siderail 600 of the left foot siderail assembly 130 do not extend beyond the head end 102 and the foot end 104 of the bed 100, which reduces the space required to store the bed 100 and which prevents undesirable contact of the siderails with walls or medical personnel when the siderails are lowered.

Figure 19:
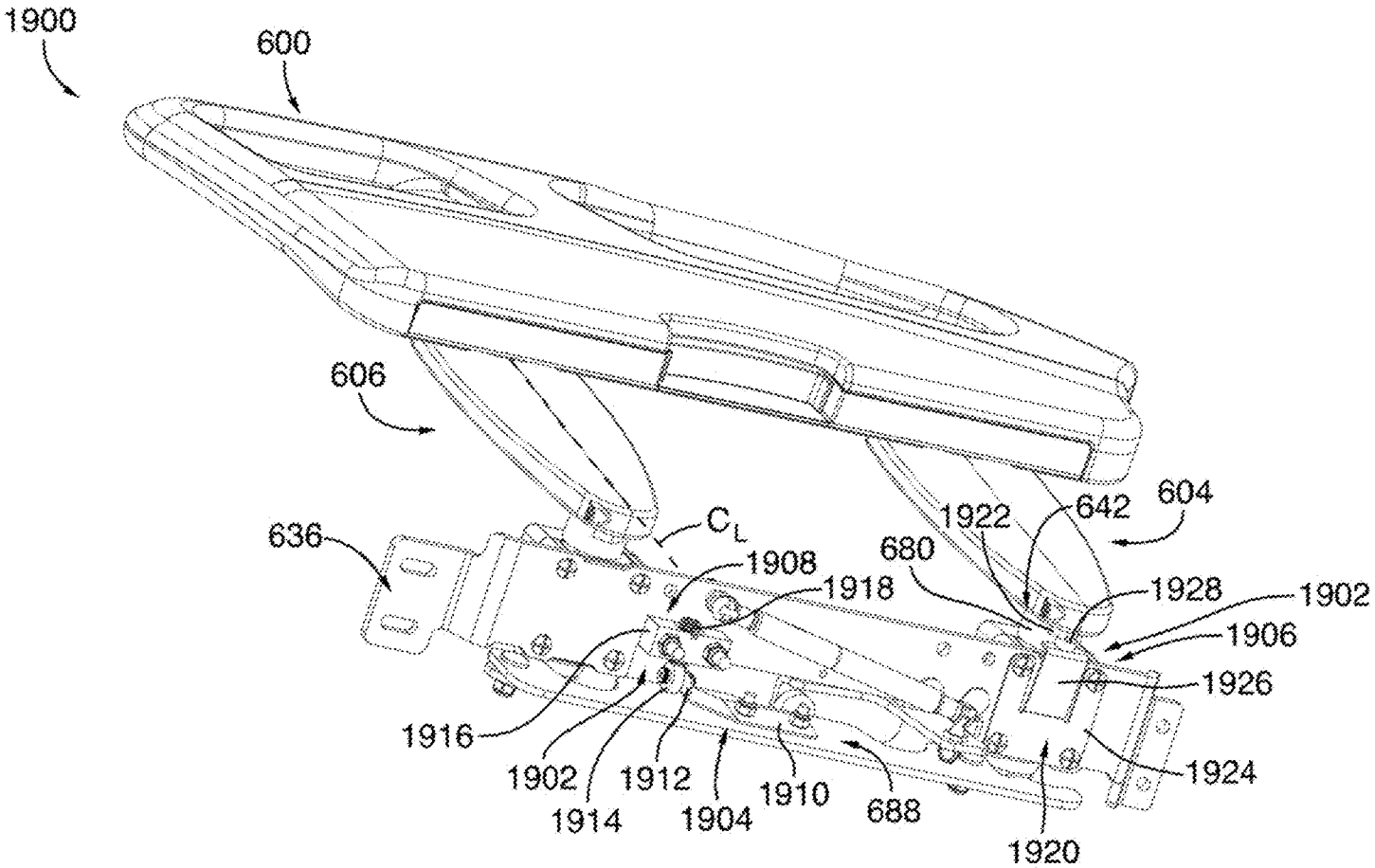
FIG. 19 is a bottom perspective view of a left foot siderail assembly in accordance with an alternative embodiment to that shown in FIG. 1.
Figure 20:
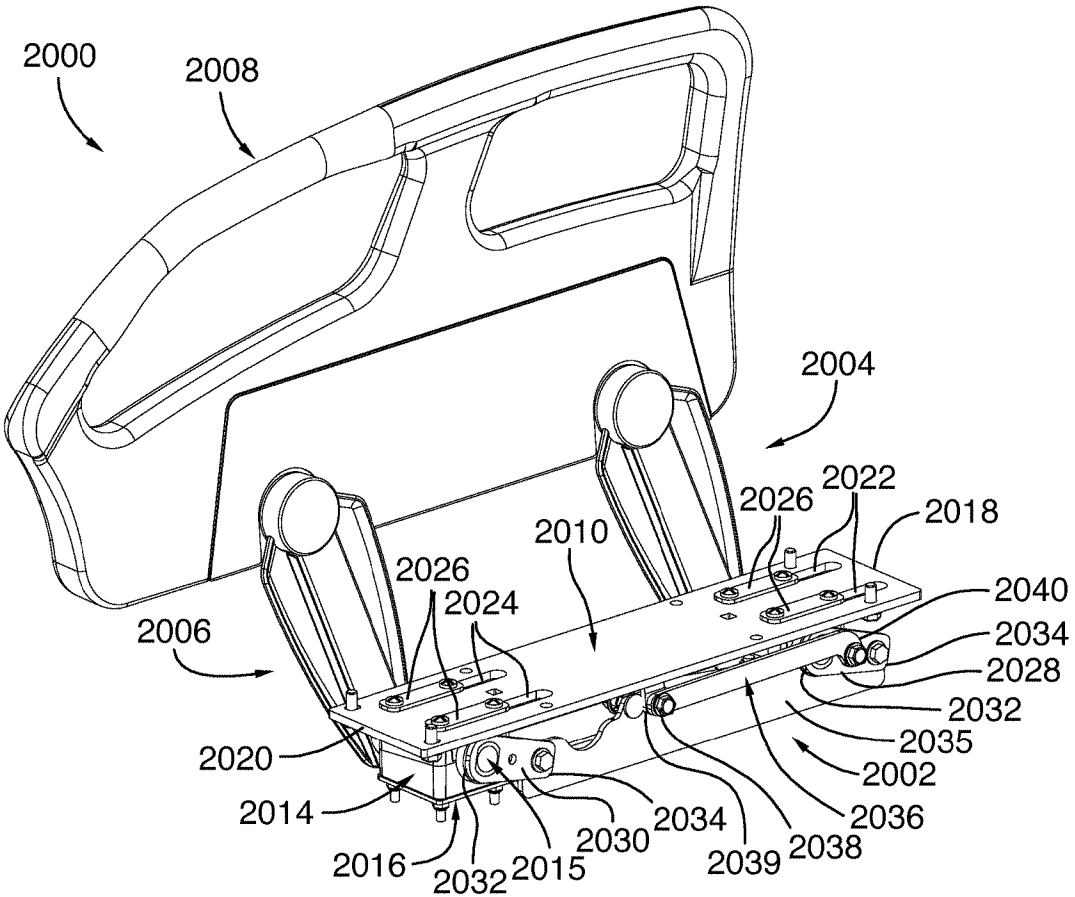
FIG. 20 is a top inner perspective view of a left foot siderail assembly in accordance with yet another alternative embodiment to that shown in FIG. 1, with the siderail in the raised position.
Figure 21:
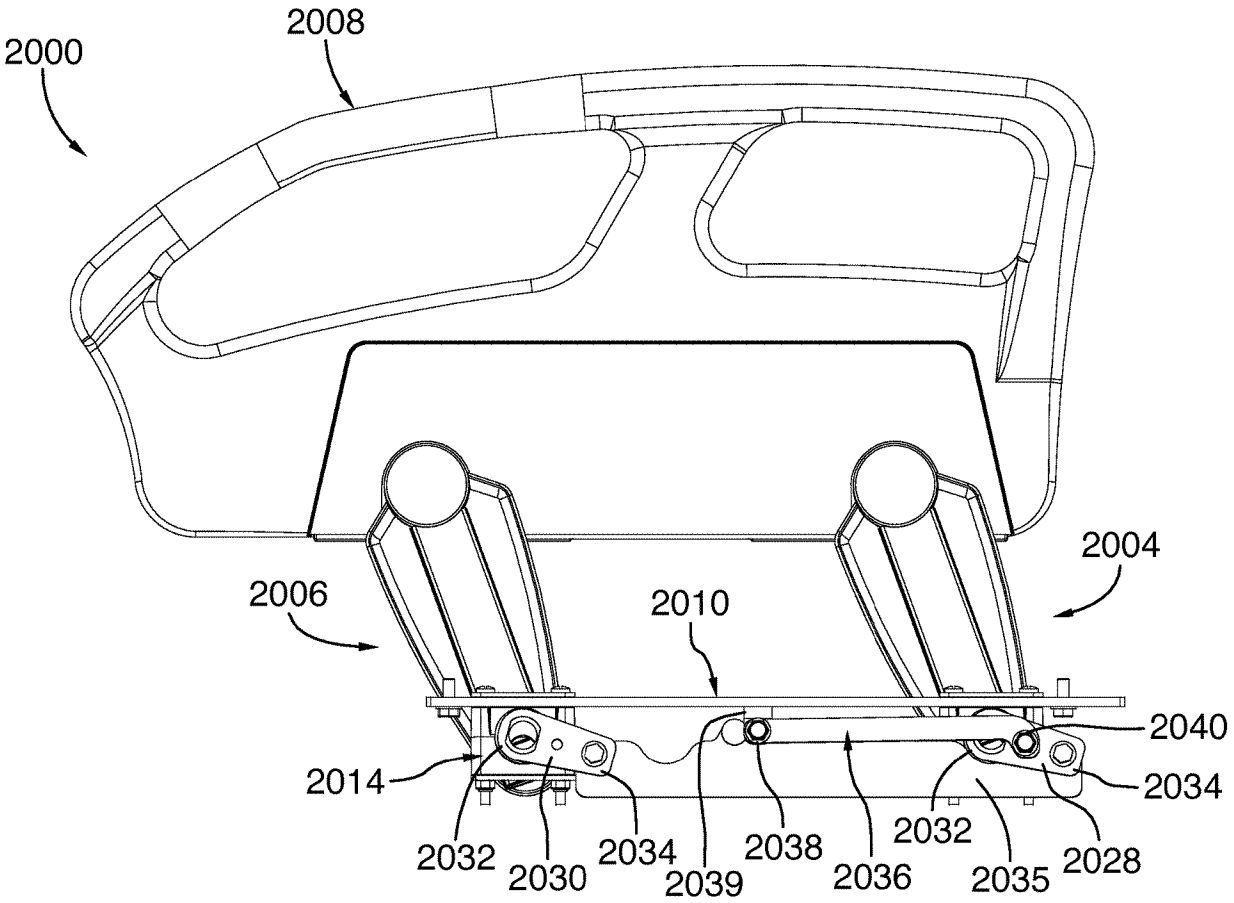
FIG. 21 is an inner side elevation view of the left foot siderail assembly illustrated in FIG. 20.
Figure 22:
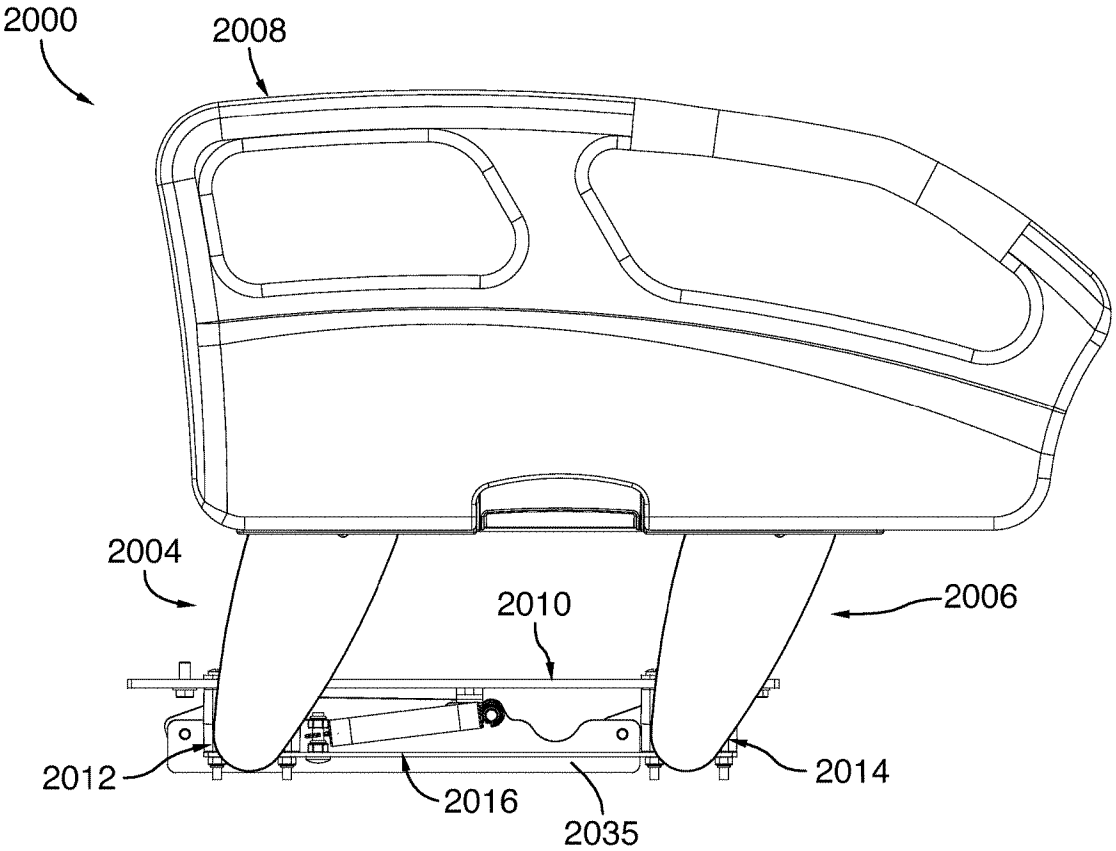
FIG. 22 is an outer side elevation view of the left foot siderail assembly illustrated in FIG. 20.

Now turning to FIG. 19, there is shown a right foot siderail assembly 1900, according to another embodiment. The right foot siderail assembly 1900 is generally similar to the right foot siderail assembly illustrated in FIGS. 6 to 11, but further comprises a nudging assembly 1902 configured for preventing the siderail 600 from remaining at an intermediate position in which the centerline $C_L$ of the connecting arms is at an angle of 90 degrees relative to the horizontal.

It will be appreciated that this situation would not be desirable, because the siderail 600 would thereby be stuck in an unstable equilibrium and could suddenly and unexpectedly move towards one of the raised and lowered positions, for example if the bed 100 is moved.

In the embodiment illustrated in FIG. 19, the nudging assembly 1902 comprises a first nudging subassembly 1904 adapted to cooperate with the abutment member 688 and a second nudging subassembly 1906 adapted to cooperate with one of the connecting members 604, 606.

The first nudging subassembly 1904 comprises a first leaf spring 1906 secured to the abutment member 688 and a first cam member 1908 secured to the underside of the mounting plate 636. The first leaf spring 1906 is located towards the first cam member 1908 and comprises a base portion 1910 fastened to the abutment member 688 and a free end portion 1912 resiliently connected to the base portion 1910. A first roller 1914 is further rotatably mounted to the free end portion 1912 of the first leaf spring 1906.

In the illustrated embodiment, the first cam member 1908 comprises a base 1916 fastened to the mounting plate 636 and a pointed screw 1918 which extends through the base 1916 and points towards the abutment member 688. Alternatively, the first cam member 1908 could instead be made of a single, unitary piece of material or could have any other configuration deemed by the skilled addressee to be suitable.

The first cam member 1908 and the first leaf spring 1906 are disposed relative to each other such that the pointed screw 1918 contacts the first roller 1914 and biases away the free end portion 1912 of the first leaf spring 1906 when the siderail 600 is in the intermediate position in which the centerlines $C_L$ of the connecting arms 604, 606 define an angle of 90 degrees relative to the horizontal, as shown in FIG. 19. Therefore, the first roller 1914 pushes against the pointed screw 1918 until the first roller 1914 rolls on the pointed screw 1918 and moves laterally relative to the pointed screw 1918, thereby forcing movement of the abutment member 688 which nudges the siderail 600 towards one of the raised position and the lowered position. It will be appreciated that the first roller 1914 has a curved outer face which minimizes the area of contact between the first roller 1914 and the pointed screw 1918, which thereby reduces friction between the first roller 1914 and the pointed screw 1918. Friction is also reduced by the ability of the first roller 1914 to roll rather than simply slide on the pointed screw 1918. This allows the first roller 1914 to remain in contact with the pointed screw 1918 for a minimal amount of time before being forced laterally relative to the pointed screw 1918, thereby preventing the siderail 600 from remaining at the intermediate, vertical position.

The second nudging subassembly 1906 comprises a second leaf spring 1920 secured to the underside of the mounting plate 636 and a second cam member 1922 extending radially and outwardly from the first end 680 of one of the lower shafts 642. The second leaf spring 1920 comprises a base portion 1924 and a free end portion 1926 resiliently connected to the base portion 1924. A second roller 1928 is further rotatably mounted to the free end portion 1926 of the second leaf spring 1920, similarly to the first leaf spring 1906.

In the illustrated embodiment, the second cam member 1922 is integrally formed with the lower shaft 642. Alternatively, the second cam member 1922 could be distinct from the lower shaft 642 and secured to the lower shaft 642.

The second nudging subassembly 1906 works substantially the same way as the first nudging subassembly 1904. Specifically, the second cam member 1922 and the second leaf spring 1920 are disposed relative to each other such that the second cam member 1922 contacts the second roller 1928 and biases away the free end 1926 of the second leaf spring 1920 when the siderail 600 is in the intermediate position. The second roller 1928 therefore pushes against the second cam member 1922 until the second roller 1928 rolls on the second cam member 1922 and forces the lower shaft 642 to pivot, thereby forcing movement of the abutment member 688 which nudges the siderail 600 towards one of the raised position and the lowered position.

Alternatively, the nudging assembly 1902 could further comprise a third nudging subassembly similar to the second nudging subassembly 1906 and configured for cooperating with the lower shaft 642 of the other one of the connecting members 604, 606. In yet another embodiment, the nudging assembly 1902 could only comprise one of the first and second nudging subassemblies 1904, 1906.

Now turning to FIGS. 20 to 24, there is shown a left foot siderail assembly 2000, according to one embodiment. Similarly to the right foot siderail assembly 132 illustrated in FIGS. 6 to 11, the left foot siderail assembly 2000 comprises a motion control assembly 2002, footward and headward connecting arms 2004, 2006 pivotably connected to the motion control assembly 2002 and a siderail 2008 pivotably connected to the connecting arms 2004, 2006. In this embodiment, the pivoting of the siderail 2008 also cause the siderail 2008 to move longitudinally relative to the bed 100.

The motion control assembly 2002 comprises a mounting plate 2010 and footward and headward pillow blocks 2012, 2014 slidably connected to the mounting plate 2010. The pillow blocks 2012, 2014 are adapted to receive a lower shaft 2015 of the connecting arms 2004, 2006. The pillow blocks 2012, 2014 depend from the mounting plate 2010 and are further attached together by a rigid member 2016 (best shown in FIG. 22) which connects the pillow blocks 2012, 2014 together in order to cause longitudinal movement of one of the pillow blocks 2012, 2014 if the other one of the pillow blocks 2012, 2014 is moved longitudinally. Specifically, the mounting plate 2010 is generally flat and has a footward end 2018 and a headward end 2020. The mounting plate 2010 includes a first pair of slots 2022 located near its footward end 2018 and a second pair of slots 2024 located near its headward end 2020, the slots 2022, 2024 extending longitudinally relative to the mounting plate 2010 and to the bed 100.

Each pillow block 2012, 2014 comprises a pair of elongated sliders 2026 which are configured for engaging a respective one of the first and second pair of slots 2022, 2024. The elongated sliders 2026 are shorter than the slots 2022, 2024 to allow the sliders 2026 to slide within the slots 2022, 2024. The motion control assembly 2002 further comprises footward and headward cranks 2028, 2030 secured to the lower shafts 2015 of the footward and headward connecting arms 2004, 2006, respectively. Each crank 2028, 2030 comprises a first end 2032 secured to the lower shaft 2015 and a second end 2034 located away from the first end 2032. The motion control assembly 2002 further includes an abutment member 2035 extending between the second ends 2034 of the cranks 2028, 2030 to connect the cranks 2028, 2030 together.

Figure 23:
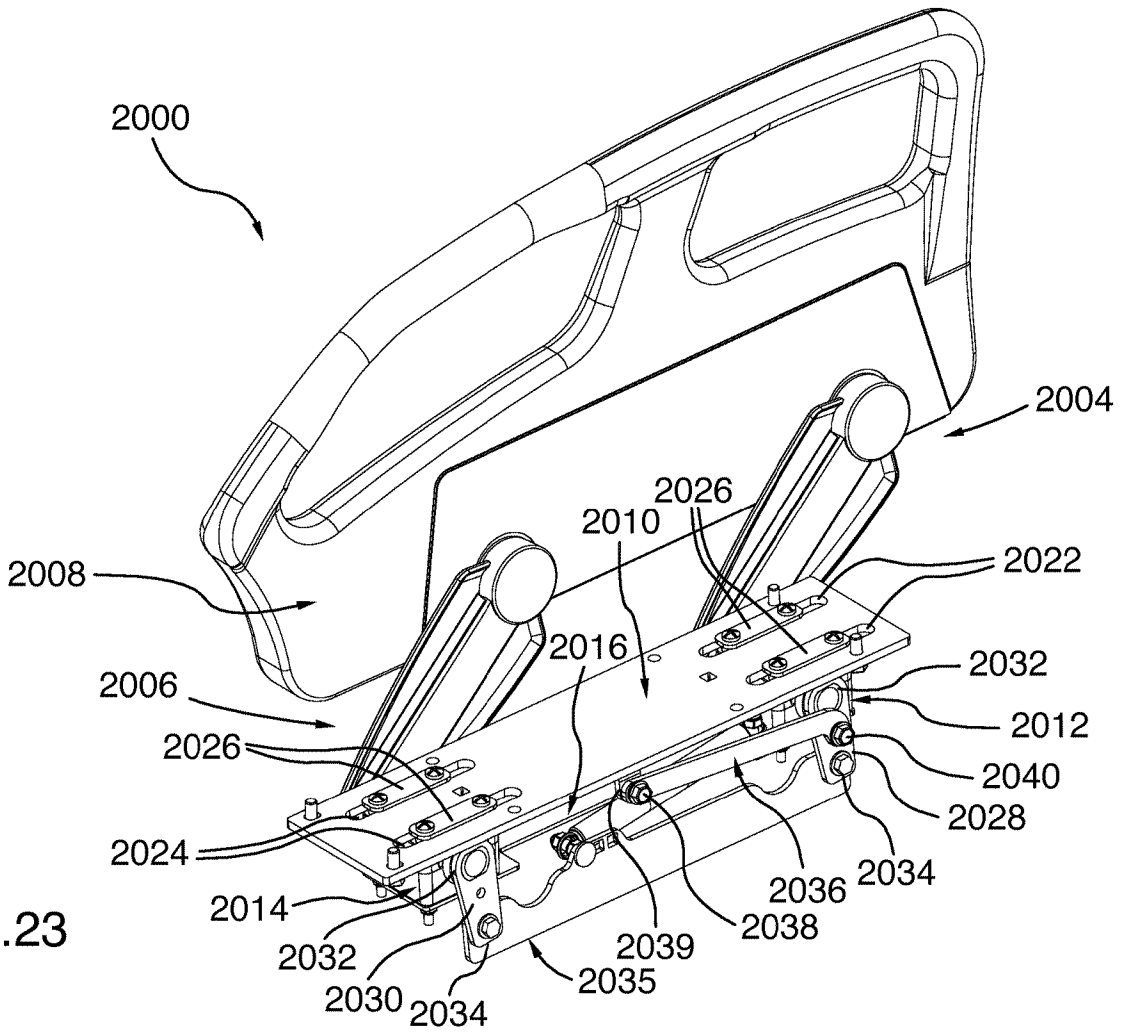
FIG. 23 is a partial top inner perspective view of the left foot siderail assembly illustrated in FIG. 20, with the siderail shown occupying an intermediate position between the raised position and the lowered position.
Figure 24:
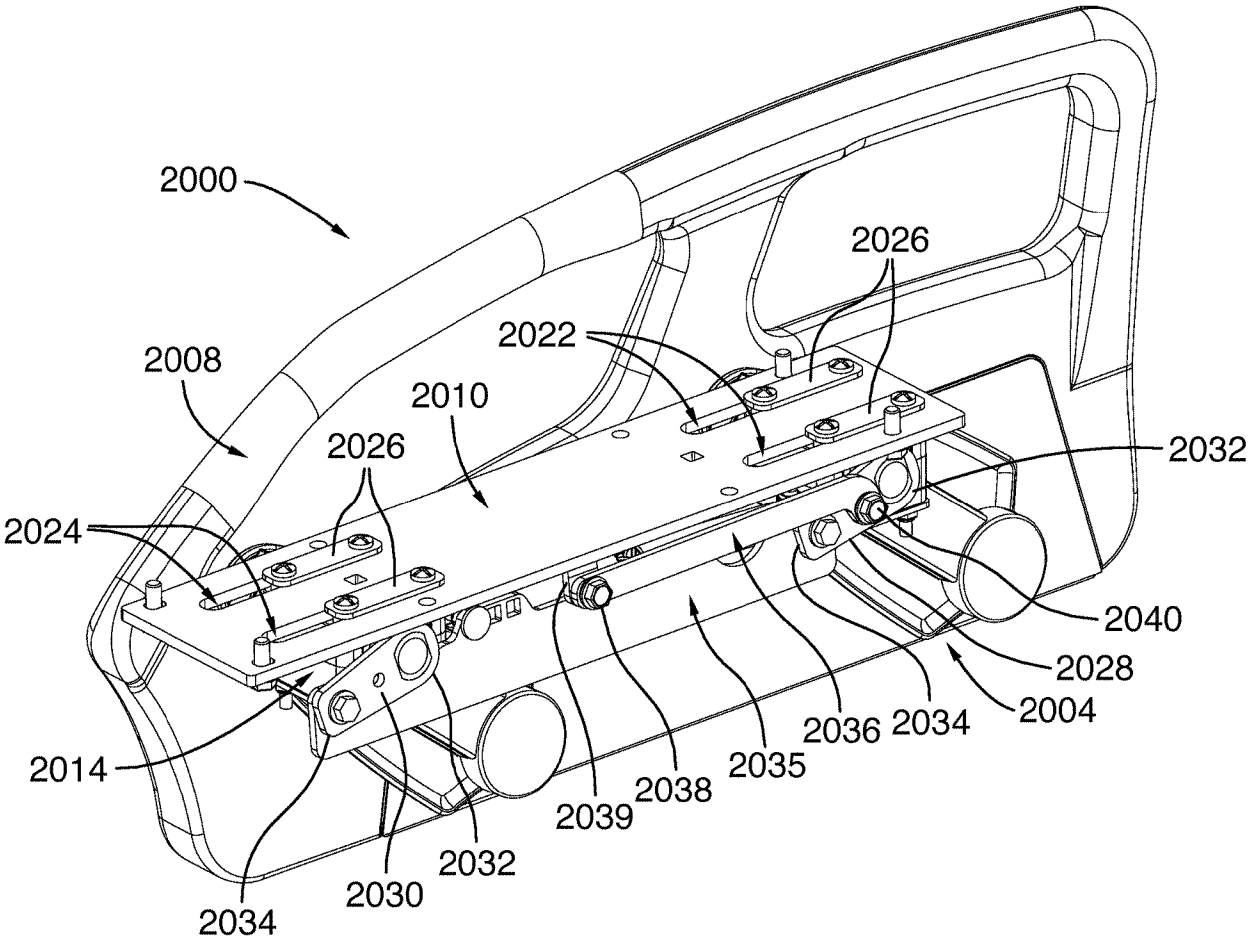
FIG. 24 is a partial top inner perspective view of the left foot siderail assembly illustrated in FIG. 20, with the siderail in the lowered position.

The motion control assembly 2002 further includes a connecting rod or holding arm 2036 extending between the mounting plate 2010 and the footward crank 2028. Specifically, the holding arm 2036 has a first end 2038 connected to an arm bracket 2039 extending downwardly from the mounting plate 2010 and a second end 2040 pivotably connected to the footward crank 2028 between the first and second ends 2032, 2034 of the footward crank 2028. When the siderail 2008 is pivoted, the footward crank 2028 pivots about the second end 2040 of the holding arm 2036. Since the second end 2040 of the holding arm 2036 is generally maintained at the same horizontal position by the holding arm 2036, the first end 2032 of the footward crank 2028, by rotating, will move in the same direction as the direction in which the siderail 2008 is pivoted. For example, if the siderail 2008 is pivoted towards the foot end 104 of the bed 100, the first end 2032 of the footward crank 2028, and thereby the lower shaft 2015 of the footward connecting arm 2004, will also move towards the foot end 104 of the bed 100. This will cause the footward pillow block 2012 to also move towards the foot end 104 of the bed 100 while being guided by the sliders 2026 in the slots 2022, 2024, as shown in FIGS. 23 and 24. Since the headward pillow block 2014 is connected to the front pillow block by the rigid member rigid member 2016 and the siderail 2008, the headward pillow block 2014 will also move towards the foot end 104 of the bed 100, and therefore the entire siderail 2008 will move towards the foot end 104 of the bed 100.

It will be appreciated that the pivoting of the footward crank 2028 may cause a slight downward pivoting of the holding arm 2036 about its first end 2038. The first end 2038 of the holding arm 2036 may therefore be pivotably connected to the arm bracket 2039.

It will further be appreciated that the mounting plate 2010 could instead comprise a single slot associated with each one of the pillow blocks 2012, 2014.

Figure 25:
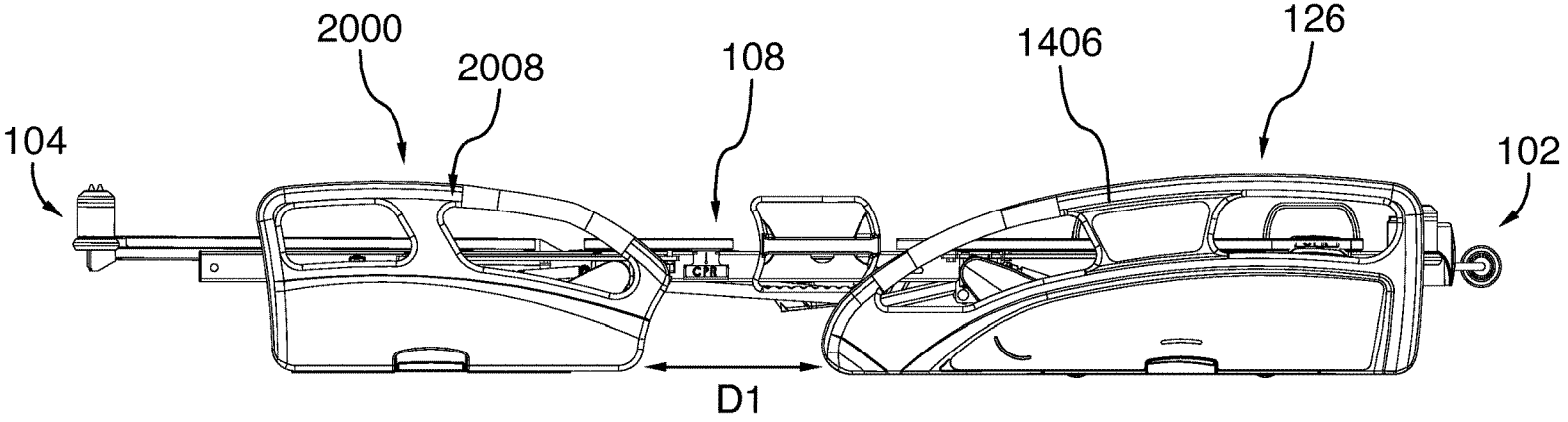
FIG. 25 is a left side elevation view of a patient support assembly similar to that illustrated in FIG. 2, except that the left foot siderail assembly is as shown in FIG. 20; the siderails of the left foot siderail assembly and of the left head siderail assembly both being shown moved to their respective lowered positions.

Now turning to FIG. 25, when both the head and foot siderails on a same side of the bed 100 are in the lowered position and the foot siderail is configured similarly to the embodiment illustrated in FIGS. 20 to 24, the bed 100 provides sufficient space between the head and foot siderails to allow the patient to comfortably get in and out of the bed 100 and to sit on the edge of the bed 100. For example, when the siderail 1406 of the left head siderail assembly 126 and the siderail 2008 of the left foot siderail assembly 2000 are both in the lowered position, they are spaced from each other by a distance $D_1$ of 15 inches or 42.93 cm. Alternatively, the siderail 1406 of the left head siderail assembly 126 and the siderail 2008 of the left foot siderail assembly 2000 could be spaced from each other by a different distance $D_1$.

It will also be appreciated that in the configuration illustrated in FIG. 25, the siderail 1406 of the left head siderail assembly 126 and the siderail 2008 of the left foot siderail assembly 2000 do not extend beyond the head end 102 and the foot end 104 of the bed 100, which may be desirable as explained above.

Figure 26:
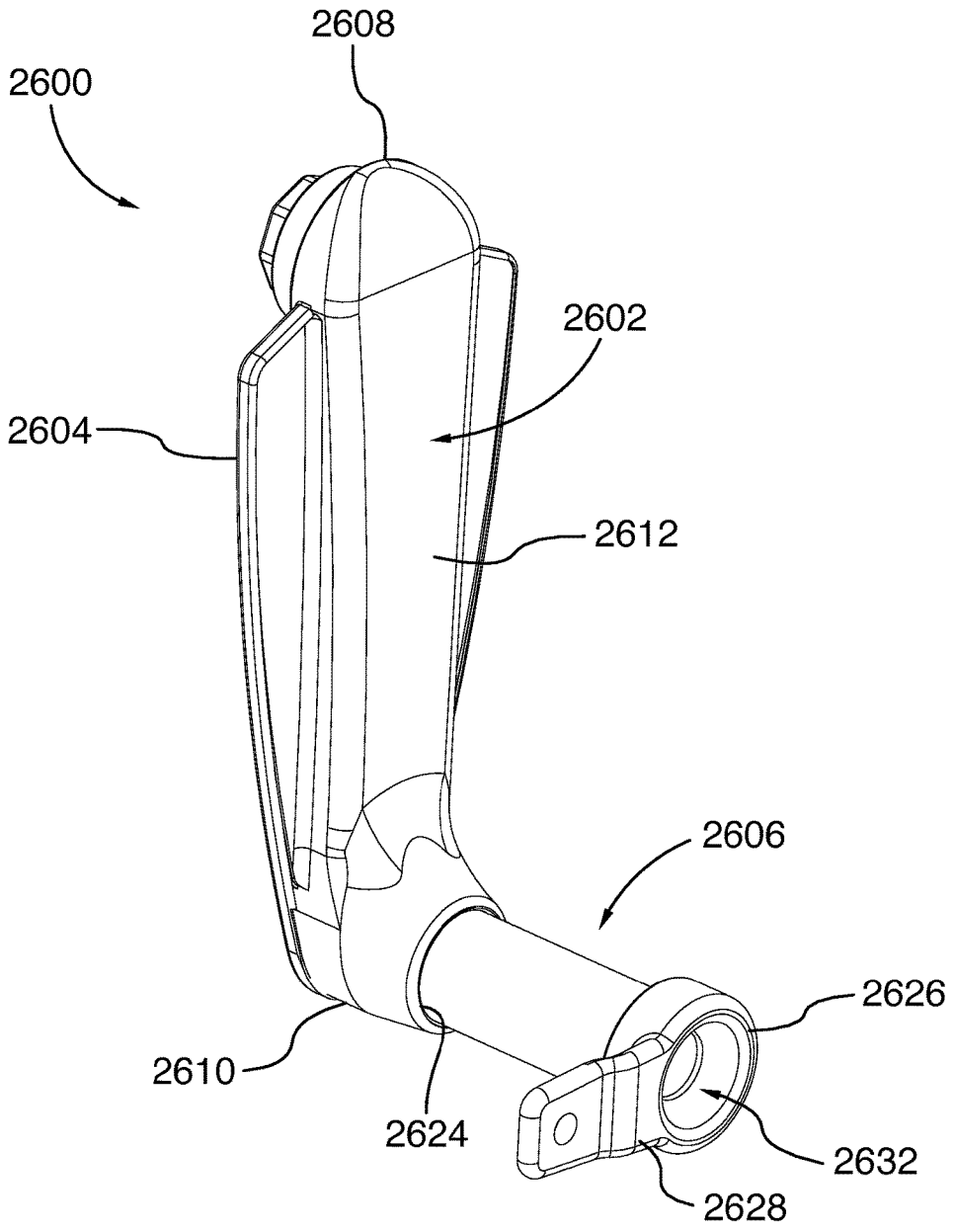
FIG. 26 is a top inner perspective view of a connection arm in accordance with an alternative embodiment to that shown in FIG. 6A.
Figure 27:
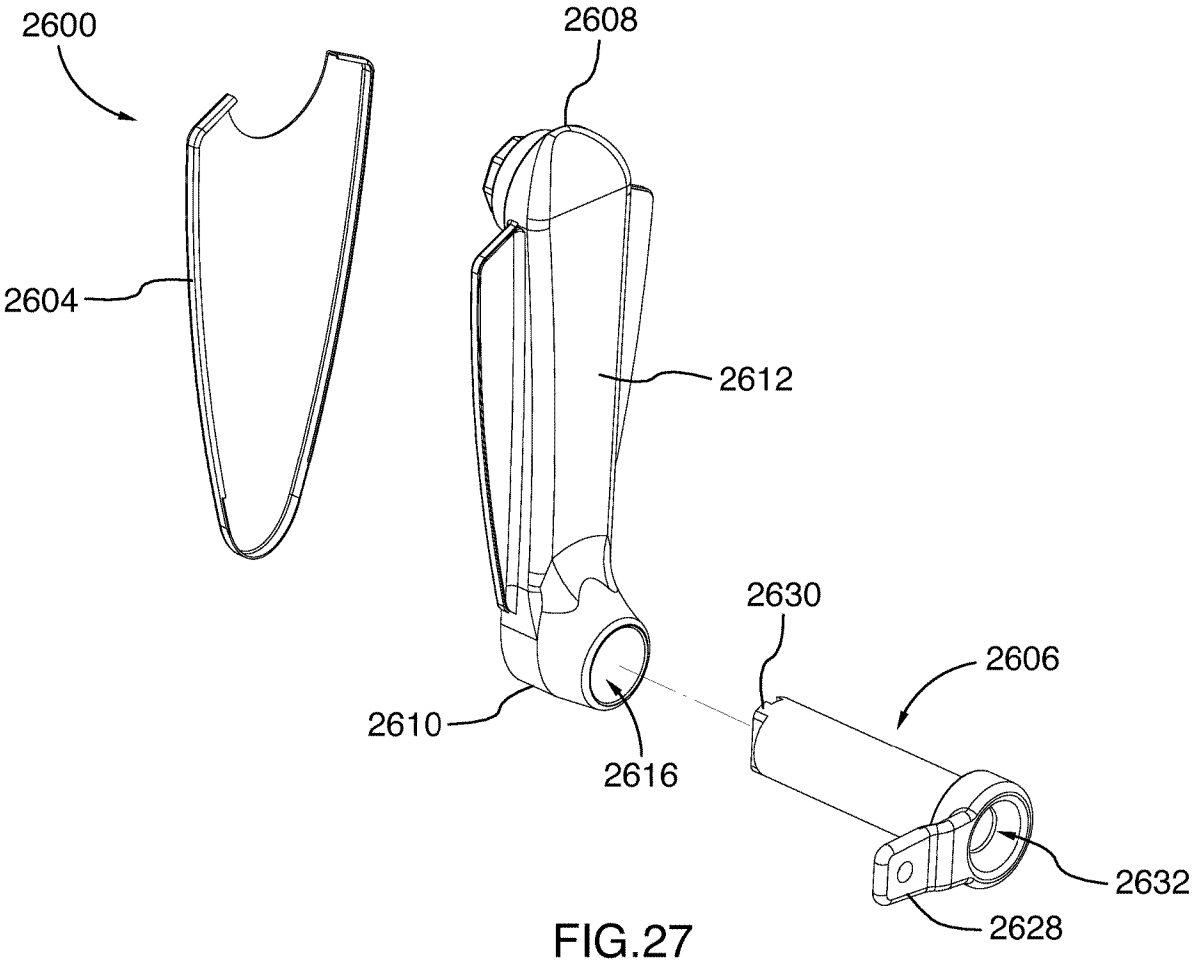
FIG. 27 is an exploded, top inner perspective view of the connection arm shown in FIG. 26.
Figure 28:
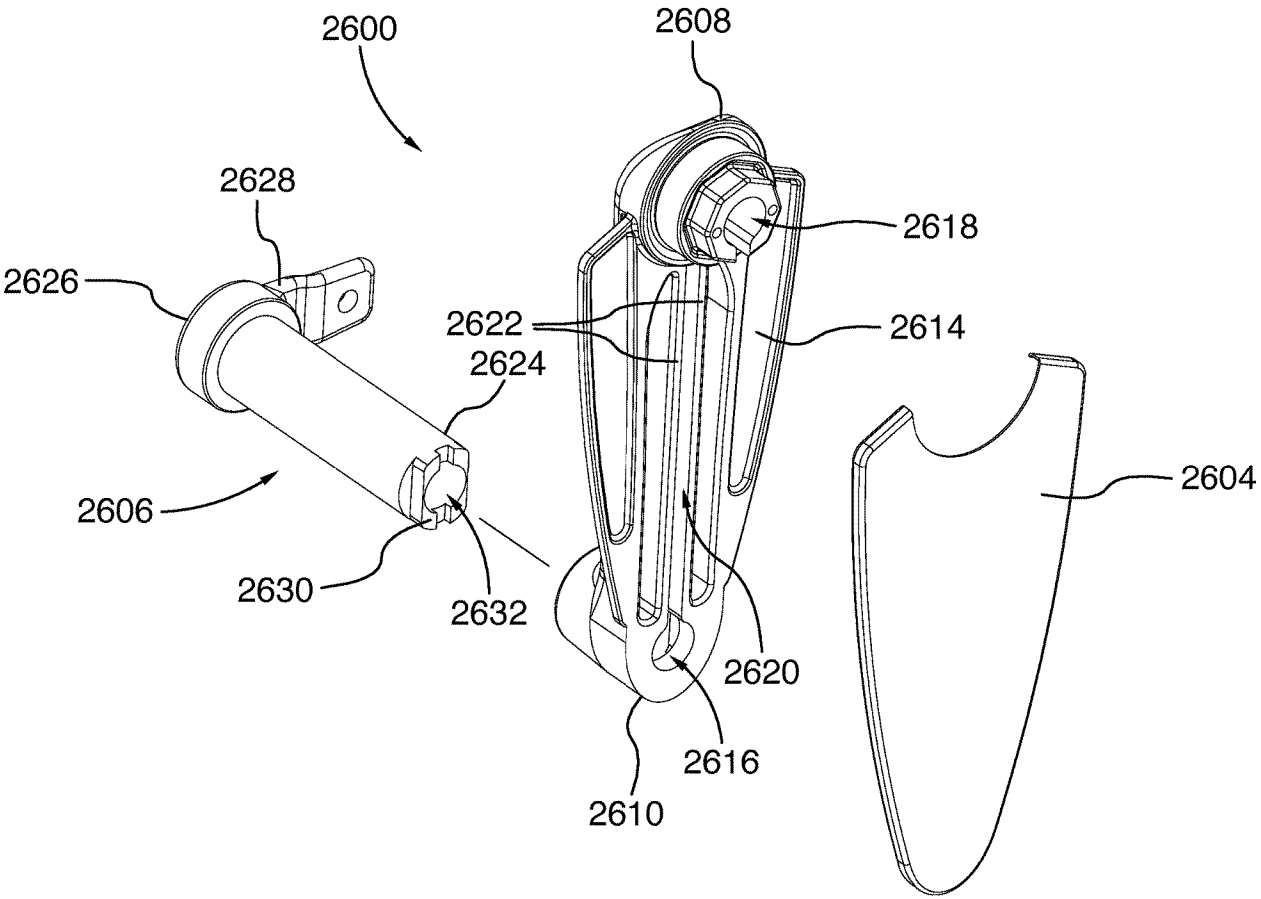
FIG. 28 is an exploded, top outer perspective view of the connection arm shown in FIG. 26.

Referring now to FIGS. 26 to 28, there is shown a connecting arm 2600, in accordance with one embodiment.

Unlike the connecting arms 604, 606 described above in connection with FIGS. 6 to 11, the connecting arm 2600 does not comprise a central arm member. Instead, the entire connecting arm 2600 is made of a shell comprising one or more distinct parts. In the illustrated embodiment, the connecting arm 2600 comprises a main body member 2602, a cover member 2604 secured to the main body member 2602 and a shaft member 2606 extending away from the main body member 2602. More specifically, the main body member 2602 has a top end 2608, a bottom end 2610, an inner face 2612 and an outer face 2614. The main body member 2602 further includes a bottom opening 2616 which is located in its inner face 2612 near its bottom end 2610 and which extends all the way through the main body member 2602. The main body member 2602 further includes a top opening 2618 which is located on the outer face 2614 near the top end 2608 and a channel 2620 between the bottom opening 2616 and the top opening 2618 is defined on the outer face 2614. The channel 2620 extends between two sidewalls 2622 which act as ribs to enhance the rigidity of the connecting arm 2600.

The shaft member 2606 has a first end 2624 inserted in the bottom opening 2616 and an opposite second end 2626. In the illustrated embodiment, the shaft member 2606 further comprises a crank 2628 located at its second end 2626 and which is integrally formed with the shaft member 2606. Still in the illustrated embodiment, the first end 2624 of the shaft member 2606 includes a key 2630 which is adapted to engage a keyway portion (not shown) located in the main body member 2602 when the shaft member 2606 is inserted in the bottom opening 2616 to lock the shaft member 2606 and the crank 2628 in rotation with the main body member 2602.

The shaft member 2606 is also hollow and defines a conduit 2632 which is in communication with the channel

2620 and the top opening 2618 of the main body member 2602. In one embodiment, a control interface is provided in the siderail pivotably connected to the connecting arm 2600. In this configuration, wires can be passed through the top opening 2618, through the channel 2620 and through the conduit 2632 to be connected to a control module or electrical or electronic device located elsewhere on the bed 100.

The cover member 2604 can be secured over the outer face of the main body member 2602 for masking the wires and preventing dirt and pathogens from entering the main body member 2602. The cover member 2604 also provides a smooth surface which may facilitate cleaning.

Alternatively, instead of comprising three distinct parts, the connecting arm 2006 may comprise a single part or any number of parts which may facilitate the manufacturing or assembly of the connecting arm 2600. In one embodiment, the parts are molded, but alternatively the parts of the connecting arm 2600 could be made using any other suitable technique known to the skilled addressee.

In the embodiments illustrated in FIGS. 1 through 28, all of the edges of all siderail panels are rounded. This may help to prevent injuries to the patient or to the medical personnel and to prevent cords and straps from becoming snagged in the siderails. This also facilitates cleaning of the siderail panels, since the entire panel can be wiped clean more easily.

Still in the embodiments illustrated in FIGS. 1 through 28, the siderail panels are made from a plastic material such as polypropylene, nylon or the like and are molded. Specifically, the siderail panels may be injection molded, which may reduce the weight and cost of the siderail panels. Alternatively, the siderail panels may be made of another material known to the skilled addressee, or be made by another technique known to the skilled addressee. In one embodiment, a bactericidal agent is further incorporated into the plastic material used to manufacture the siderail panels to facilitate cleaning of the panels.

It will be understood that although the present description refers to a hospital bed, other patient support devices, such as stretchers, adjustable chairs, home-care beds, etc., are also suitable for use with the described systems. Moreover, the term "patient" is not intended to be limiting, and can be taken to apply to any user of the support device, such as an individual undergoing short-term, medium-term or long-term care, a hospital patient, a nursing home resident, etc.

The embodiments described above are intended to be exemplary only. The scope of the invention is therefore intended to be limited solely by the appended claims.

We claim:

1. A siderail assembly for a bed, the bed having a patient support assembly, the siderail assembly comprising: a siderail disposed in a siderail plane; the siderail comprising an outer face and an inner face, wherein the inner face includes a top portion that is generally planar and generally parallel to the siderail plane and a bottom portion that is angled towards the patient support assembly; a mounting member for mounting to the patient support assembly; at least two parallel connecting arms, each connecting arm having a first end pivotably connected to the mounting member and a second end pivotably connected to the bottom portion of the inner face of the siderail, each connecting arm being adapted to pivot relative to the siderail about a first pivot axis and to pivot relative to the mounting member about a second pivot axis to allow the siderail to pivot along an arcuate path relative to the mounting member and to move in a direction perpendicular to the siderail plane when pivoting, wherein at least one connecting arm is disposed in an arm plane, the arm plane being angled outwardly from the patient support assembly when the connecting arm is in a raised position.

2. The siderail assembly as claimed in claim 1, wherein the connecting arms are adapted such that the first and second pivot axes are parallel to each other and angled downwardly relative to a horizontal plane to allow the siderail to pivot between a raised position in which the siderail is in a first siderail plane and a lowered position in which the siderail is in a second siderail plane parallel to the first siderail plane and spaced therefrom.

3. The siderail assembly as claimed in claim 1, wherein each connecting arm is disposed in an arm plane, the arm plane being angled relative to the siderail plane.

4. The siderail assembly as claimed in claim 1, wherein the siderail plane is vertical.

5. The siderail as claimed in claim 1, wherein said siderail motion assembly includes a damper connecting the mounting member to at least one of the at least two connecting arms for damping the pivoting of the siderail.

6. The siderail assembly as claimed in claim 1, further comprising a locking assembly movable between a locked position preventing the pivoting of the siderail and an unlocked position allowing the pivoting of the siderail.

7. The siderail assembly as claimed in claim 1, further comprising an indicator for providing an indication of whether the locking assembly is in the locked position or the unlocked position.

8. The siderail assembly as claimed in claim 1, further comprising a nudging assembly for preventing the siderail from remaining at an intermediate position in which a centerline of the connecting arms is at an angle of 90 degrees relative to the horizontal.

* * * * *